US007707034B2

(12) United States Patent
Sun et al.

(10) Patent No.: US 7,707,034 B2
(45) Date of Patent: Apr. 27, 2010

(54) AUDIO CODEC POST-FILTER

(75) Inventors: Xiaoqin Sun, Redmond, WA (US); Tian Wang, Redmond, WA (US); Hosam A. Khalil, Redmond, WA (US); Kazuhito Koishida, Redmond, WA (US); Wei-Ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 780 days.

(21) Appl. No.: 11/142,603

(22) Filed: May 31, 2005

(65) Prior Publication Data

US 2006/0271354 A1 Nov. 30, 2006

(51) Int. Cl.
*G10L 19/00* (2006.01)

(52) U.S. Cl. ..... 704/262; 704/228; 704/500; 704/258; 381/312; 381/320

(58) Field of Classification Search ..... 704/228, 704/500, 258, 262; 381/312, 320
See application file for complete search history.

(56) References Cited

U.S. PATENT DOCUMENTS 4,815,134 A 3/1989 Picone et al.
4,969,192 A 11/1990 Chen et al.
5,255,339 A 10/1993 Fette et al.
5,394,473 A 2/1995 Davidson
5,615,298 A * 3/1997 Chen ..... 704/228
5,664,051 A 9/1997 Hardwick et al.
5,664,055 A 9/1997 Kroon
5,668,925 A 9/1997 Rothweiler et al.
5,699,477 A 12/1997 McCree
5,699,485 A 12/1997 Shoham
5,717,823 A 2/1998 Kleijn
5,724,433 A * 3/1998 Engebretson et al. ..... 381/106
5,734,789 A 3/1998 Swaminathan et al.
5,737,484 A 4/1998 Ozawa
5,751,903 A 5/1998 Swaminathan et al.
5,778,335 A 7/1998 Ubale et al.
5,819,212 A 10/1998 Matsumoto et al.
5,819,298 A * 10/1998 Wong et al. ..... 707/205
5,835,495 A 11/1998 Ferriere (Continued)

FOREIGN PATENT DOCUMENTS

CA 1336454 7/1995

(Continued)

OTHER PUBLICATIONS

Andersen et al., "ILBC—a Linear Predictive Coder with Robustness to Packet Losses," Proc. IEEE Workshop on Speech Coding, 2002, pp. 23-25 (2002).

(Continued)

*Primary Examiner*—Daniel D Abebe
(74) *Attorney, Agent, or Firm*—Klarquist Sparkman, LLP

(57) ABSTRACT

Techniques and tools are described for processing reconstructed audio signals. For example, a reconstructed audio signal is filtered in the time domain using filter coefficients that are calculated, at least in part, in the frequency domain. As another example, producing a set of filter coefficients for filtering a reconstructed audio signal includes clipping one or more peaks of a set of coefficient values. As yet another example, for a sub-band codec, in a frequency region near an intersection between two sub-bands, a reconstructed composite signal is enhanced.

31 Claims, 7 Drawing Sheets

U.S. PATENT DOCUMENTS 5,845,244 A 12/1998 Proust
5,870,412 A 2/1999 Schuster et al.
5,873,060 A 2/1999 Ozawa
5,890,108 A 3/1999 Yeldener
6,009,122 A 12/1999 Chow
6,029,126 A 2/2000 Malvar
6,041,345 A 3/2000 Levi et al.
6,064,962 A * 5/2000 Oshikiri et al. ..... 704/262
6,108,626 A 8/2000 Cellario et al.
6,122,607 A 9/2000 Ekudden et al.
6,128,349 A 10/2000 Chow
6,134,518 A 10/2000 Cohen et al.
6,199,037 B1 3/2001 Hardwick
6,202,045 B1 3/2001 Ojala et al.
6,226,606 B1 5/2001 Acero
6,240,387 B1 5/2001 DeJaco
6,263,312 B1 7/2001 Kolesnik et al.
6,289,297 B1 9/2001 Bahl
6,292,834 B1 9/2001 Ravi et al.
6,310,915 B1 10/2001 Wells et al.
6,311,154 B1 10/2001 Gersho et al.
6,317,714 B1 11/2001 Del Castillo
6,330,533 B2 12/2001 Su et al.
6,351,730 B2 2/2002 Chen
6,385,573 B1 5/2002 Gao et al.
6,392,705 B1 5/2002 Chaddha
6,408,033 B1 6/2002 Chow et al.
6,434,247 B1 * 8/2002 Kates et al. ..... 381/312
6,438,136 B1 8/2002 Bahl
6,460,153 B1 10/2002 Chou et al.
6,493,665 B1 12/2002 Su et al.
6,499,060 B1 12/2002 Wang et al.
6,505,152 B1 1/2003 Acero
6,564,183 B1 5/2003 Hagen et al.
6,614,370 B2 9/2003 Gottesman
6,621,935 B1 9/2003 Xin et al.
6,633,841 B1 10/2003 Thyssen et al.
6,647,063 B1 11/2003 Oikawa
6,647,366 B2 11/2003 Wang et al.
6,658,383 B2 12/2003 Kazuhito et al.
6,693,964 B1 2/2004 Zhang et al.
6,732,070 B1 5/2004 Rotola-Pukkila et al.
6,757,654 B1 6/2004 Westerlund et al.
6,772,126 B1 8/2004 Simpson et al.
6,775,649 B1 8/2004 DeMartin
6,823,303 B1 11/2004 Su et al.
6,934,678 B1 8/2005 Yang
6,952,668 B1 10/2005 Kapilow
6,968,309 B1 11/2005 Makinen et al.
7,003,448 B1 2/2006 Lauber et al.
7,065,338 B2 6/2006 Mano et al.
7,117,156 B1 10/2006 Kapilow
7,246,037 B2 7/2007 Evans
7,356,748 B2 4/2008 Taleb
2001/0023395 A1 9/2001 Su et al.
2002/0072901 A1 * 6/2002 Bruhn ..... 704/229
2002/0097807 A1 7/2002 Gerrits
2002/0159472 A1 10/2002 Bialik
2003/0004718 A1 1/2003 Rao
2003/0009326 A1 1/2003 Wang et al.
2003/0016630 A1 1/2003 Vega-Garcia et al.
2003/0072464 A1 * 4/2003 Kates ..... 381/312
2003/0088406 A1 * 5/2003 Chen et al. ..... 704/219
2003/0088408 A1 * 5/2003 Thyssen et al. ..... 704/228
2003/0101050 A1 5/2003 Khalil
2003/0115050 A1 6/2003 Chen et al.
2003/0115051 A1 6/2003 Chen et al.
2003/0135631 A1 7/2003 Li et al.
2005/0075869 A1 4/2005 Gersho et al.
2005/0154584 A1 7/2005 Jelinek et al.
2005/0165603 A1 * 7/2005 Bessette et al. ..... 704/200.1
2005/0228651 A1 10/2005 Wang et al.
2005/0267753 A1 12/2005 Yang
2005/0281345 A1 * 12/2005 Obernosterer et al. ..... 375/260
2006/0271355 A1 11/2006 Wang et al.
2006/0271373 A1 11/2006 Khalil et al.
2007/0088558 A1 * 4/2007 Vos et al. ..... 704/275
2007/0255558 A1 11/2007 Yasunaga et al.
2007/0255559 A1 11/2007 Gao et al.
2008/0232612 A1 * 9/2008 Tourwe ..... 381/99

FOREIGN PATENT DOCUMENTS

EP 0 503 684 9/1992
EP 0 747 882 12/1996
FR 2 784 218 4/2000
GB 2 324 689 10/1998
JP 1013200 1/1989
JP 07-297726 11/1995
JP 08-263098 10/1996
JP 10-133695 5/1998
JP 10-340098 12/1998
JP 2000-132194 5/2000
JP 2002-118517 4/2002
WO WO 98 27543 6/1998
WO WO 00 11655 3/2000
WO WO 00 63882 10/2000
WO WO 00 68934 11/2000
WO WO 01 93516 12/2001
WO WO 02 37475 5/2002
WO WO 03 102921 12/2003

OTHER PUBLICATIONS

B. Bessette, R. Salami, C. Laflamme and R. Lefebvre, "A Wideband Speech and Audio Codec at 16/24/32 kbit/s using Hybrid ACELP/TCX Techniques," in Proc. IEEE Workshop on Speech Coding, pp. 7-9, 1999.

J-H. Chen and D. Wang, "Transform Predictive Coding of Wideband Speech Signals," in Proc. International Conference on Acoustic, Speech, Signal Processing, pp. 275-278, 1996.

Combescure, P., et al., "A16, 24, 32 kbit/s Wideband Speech Codec Based on ATCELP," *In Proceedings of IEEE International Conference on Acoustics, Speech, and Signal Processing*, vol. 1, pp. 5-8 (Mar. 1999).

El Maleh, K., et al., "Speech/Music Discrimination for Multimedia Applications," *In Proceedings of IEEE International Conference on Acoustics, Speech, and Signal Processing*, vol. 4, pp. 2445-2448, (Jun. 2000).

Ellis, D., et al. "Speech/Music Discrimination Based on Posterior Probability Features," *In Proceedings of Eurospeech*, 4 pages, Budapest (1999).

Erdmann et al., "An Adaptive Multi Rate Wideband Speech Codec with Adaptive Gain Re-quantization," Proc. IEEE Workshop on Speech Coding, 2000, pp. 145-147 (2000).

Erhart et al., "A speech packet recovery technique using a model based tree search interpolator," Proc. 1993 IEEE Workshop on Speech Coding for Telecommunications, pp. 77-78 (1993).

Feldbauer et al., "Speech Coding Using Motion Picture Compression Techniques," Proc. IEEE Workshop on Speech Coding, 2002, pp. 47-49 (2002).

Fingscheidt et al., "Joint Speech Codec Parameter and Channel Decoding of Parameter Individual Block Codes (PIBC)," Proc. 1999 IEEE Workshop on Speech Coding, pp. 75-77 (1999).

Gersho, A., "Advances in Speech and Audio Compression", *Proceedings of the IEEE*, vol. 82(6):900-918 (Jun. 1994).

Gersho, A., et al., "Vector Quantization and Signal Compression", Dordrecht, Netherlands,: Kluwer *Academic Publishers*, 1992, xxii×732pp.

Gerson et al., "Vector Sum Excited Linear Prediction (VSELP) Speech Coding at 8 KBPS," CH2847-2/90/0000-0461 IEEE, pp. 461-464 (1990).

Hardwick, J.C.; Lim, J.S., "A 4.8 KBPS Multi-Brand Excitation Speech Coder", *ICASSP 1988 International Conference on Acoustics, Speech, and Signal*, New York, NY, USA, Apr. 11-14, 1988,: *IEEE*, vol. 1, pp. 374-377.
Heinen et al., "Robust Speech Transmission Over Noisy Channels Employing Non-linear Block Codes," Proc. 1999 IEEE Workshop on Speech Coding, pp. 72-74 (1999).
Houtgast, T., et al., "The Modulation Transfer Function in Room Acoustics As A Predictor or Speech Intelligibility," *Acustica*, vol. 23, pp. 66-73 (1973).
Ikeda et al., "Error-Protected TwinVQ Audio Coding at Less Than 64 kbit/s/ch," Proc. 1995 IEEE Workshop on Speech Coding for Telecommunications, pp. 33-34 (1995).
ITU-T, G.722.1 (Sep. 1999), Series G: Transmission Systems and Media, Digital Systems and Networks, Coding at 24 and 32 kbit/s for hands-free operation in systems with low frame loss.
Johansson et al., "Bandwidth Efficient AMR Operation for VoIP," Proc. IEEE Workshop on Speech Coding, 2002, pp. 150-152 (2002).
Kemp, D.P.; Collura J.S., ; Tremain, T.E., Multi-Frame Coding of LPC Acoustics, Speech, and Signal Processing, Toronto, Ont., Canada, May 14-17, 1991; New York, N.Y. USA, *IEEE*, 1991, vol. 1, pp. 609-612.
Koishida et al., "Enhancing MPEG-4 CELP by Jointly Optimized Inter/Intra-frame LSP Predictors," Proc. IEEE Workshop on Speech Coding, 2000, pp. 90-92 (2000).
Kubin et al., "Multiple-Description Coding (MDC) of Speech with an Invertible Auditory Model," Proc. 1999 IEEE Workshop on Speech Coding, pp. 81-83 (1999).
Lakaniemi et al., "AMR and AMR-WB RTP Payload Usage in Packet Switched Conversational Multimedia Services," Proc. IEEE Workshop on Speech Coding, 2002, pp. 147-149 (2002).
Leblanc, W.P., et al., "Efficient Search and Design Procedures for Robust Multi-Stage VQ of LPC Parameters for 4KB/S Speech Coding". In *IEEE Trans. Speech & Audio Processing*, vol. 1, pp. 272-285, (Oct. 1993).
Lefebvre, et al., "High quality coding of wideband audio signals using transform coded excitation (TCS)," Apr. 1994, 1994 IEEE International Conference on Acoustics, Speech, and Signal Processing, vol. 1, pp. I/193-I/196.
Liang, et al., "Adaptive Playout Scheduling and Loss Concealment for Voice Communication Over IP Networks," IEEE Transactions on Multimedia, vol. 5, No. 4, pp. 532-543 (2003).
Makinen et al., "The Effect of Source Based Rate Adaptation Extension in AMR-WB Speech Codec," Proc. IEEE Workshop on Speech Coding, 2002, pp. 153-155 (2002).
Mcaulay, "Sine-Wave Amplitude Coding at Low Data Rates, Advances in Speech Coding," *Kluwer Academic Pub.*, pp. 203-214, 1991.
McCree, et al., "A 2.4 KBIT/S MELP Coder Candidate for the New U.S. Federal Standard", *1996 IEEE International Conference on Acoustics, Speech, and Signal Processing Conference Proceedings*, Atlanta, GA, (Cat. No. 96CH35903), vol. 1, pp. 200-203, May 7-10, 1996.
McCree, A.V., et al., "A Mixed Excitation LPC Vocoder Model for Low Bit Rate Speech Coding", *IEEE Transaction on Speech and Audio Processing*, vol. 3(4):242-250 (Jul. 1995).
Morinaga et al., "The Forward-Backward Recovery Sub-Codec (FB-RSC) Method: A Robust Form of Packet-Loss Concealment for Use in Broadband IP Networks," Proc. IEEE Workshop on Speech Coding, 2002, pp. 62-64 (2002).
Mouy, B. et al., "Nato Stanag 4479: A Standard for An 800 BPS Vocoder and Channel Coding In HF-ECCM System", 1995 International Conference on Acoustics, Speech, and Signal Processing Conference Proceedings, Detroit MI, USA, May 9-12, 1999; New York, NY, USA: *IEEE*, 1995, vol. 1, pp. 480-483.
Mouy, B.M.; De La Noure, P.E., "Voice Transmission at a Very Low Bit Rate on A Noisy Channel: 800 BPS Vocoder with Error Protection to 1200 BPS", *ICASSP-92: 1992 IEEE International Conference on Acoustics, Speech, and Signal*, San Francisco, CA, USA, Mar. 23-26, 1992, New York, NY, USA: *IEEE*, 1992 vol. 2, pp. 149-152.
Nishiguchi, L.; Iijima, K.; Matsumoto, J., "Harmonic Vector Excitation Coding of Speech at 2.0 KPS", *1997 IEEE Workshop on Speech coding for telecommunication proceedings*, Pocono Manor, PA, USA, Sep. 7-10, 1997, New York, NY, USA,: *IEEE*, 1997, pp. 39-40.
Nomura, T.; Iwadare, M.; Serizawa, M.; Ozawa, K., "a Bitrate and Bandwidth Scalable Celp Coder", *ICASSP 1998 International Conference on Acoustics, Speech, and Signal*, Seattle, WA, USA, May 12-15, 1998, *IEEE*, 1998, vol. 1, pp. 341-344.
Nomura et al., "Voice Over IP Systems with Speech Bitrate Adaptation Based on MPEG-4 Wideband CELP," Proc. 1999 IEEE Workshop on Speech Coding, pp. 132-134 (1999).
Ozawa et al., "Study and Subjective Evaluation on MPEG-4 Narrowband CELP Coding Under Mobile Communication Conditions," Proc. 1999 IEEE Workshop on Speech Coding, pp. 129-131 (1999).
Rahikka et al., "Error Coding Strategies for MELP Vocoder in Wireless and ATM Environments," IEEE Seminar on Speech Coding for Algorithms for Radio Channels, pp. 8/1-8/33 (2000).
Rahikka et al., "Optimized Error Correction of MELP Speech Parameters Via Maximum A Posteriori (MAP) Techniques," Proc. 1999 IEEE Workshop on Speech Coding, pp. 78-80 (1999).
Ramjee et al., "Adaptive Playout Mechanisms for Packetized Audio Application sin Wide-Area Networks," 0743-166X/94 IEEE, pp. 680-688 (1994).
S.A. Ramprashad, "A Multimode Transform Predictive Coder (MTPC) for Speech and Audio," in Proc. IEEE Workshop on Speech Coding, pp. 10-12, 1999.
Salami et al., "The Adaptive Multi-Rate Wideband Codec: History and Performance," Proc. IEEE Workshop on Speech Coding, 2002, pp. 144-146 (2002).
Salami et al., "A robust transformed binary vector excited coder with embedded error-correction coding," IEEE Colloquium on Speech Coding, pp. 5/1-5/6 (1989).
Salami, et al., "A wideband codec at 16/24 kbit/s with 10 ms frames," Sep. 1997, 1997 Workshop on Speech Coding for Telecommunications, pp. 103-104.
Saunders, J., "Real Time Discrimination of Broadcoast Speech/Music," *Proceedings of IEEE International Conference on Acoustics, Speech, and Signal Processing*, vol. 2, pp. 993-996 (May 1996).
Scheirer, E., et al., "Construction and Evaluation of a Robust Multifeature Speech/Music Discriminator," *In Proceedings of IEEE International Conference on Acoustics, Speech, and Signal Processing*, vol. 2, pp. 1331-1334, (Apr. 1997).
J. Schnitzler, J. Eggers, C. Erdmann and P. Vary, "Wideband Speech Coding Using Forward/Backward Adaptive Prediction with Mixed Time/Frequency Domain Excitation," in Proc. IEEE Workshop on Speech Coding, pp. 3-5, 1999.
Schroeder et al., "Code-Excited Linear Prediction (CELP): High-Quality Speech at Very Low Bit Rates," CH2118-8/85/0000-0937 IEEE, pp. 937-940 (1985).
Sreenan et al., "Delay Reduction Techniques for Playout Buffering," IEEE Transactions on Multimedia, vol. 2, No. 2, pp. 88-100 (2000).
Supplee, Lyn M. et al., "MELP: The New Federal Standard at 2400 BPS", *IEEE* 1997, pp. 1591-1594 in lieu of the following which we are unable to obtain *Specification for the Analog to Digital Conversation of Voice by 2,400 Bit/Second Mixed Excitation Linear Prediction FIPS, Draft document of proposed Federal Standard*, dated May 28, 1998.
Swaminathan et al., "A Robust Low Rate Voice Codec for Wireless Communications," Proc. 1997 IEEE Workshop on Speech Coding for Telecommunications, pp. 75-76 (1997).
L. Tancerel, R. Vesa, V.T. Ruoppila and R. Lefebvre, "Combined Speech and Audio Coding by Discrimination," in Proc. IEEE Workshop on Speech Coding, pp. 154-156, 2000.
Taumi et al., "13kbps Low-Delay Error-Robust Speech Coding for GSM EFR," 1995 IEEE Workshop on Speech Coding for Telecommunications, pp. 61-62 (1995).
Tzanetakis, G., et al., "Multifeature Audio Segmentation for Browsing and Annotation," *Proc. IEEE Workshop on Applications of Signal Processing to Audio and Acoustics*, New Paltz, NY, pp. 103-106 (Oct. 1999).
A. Ubale and A. Gersho, "Multi-Band CELP Wideband Speech Coder," Proc. IEEE Int. Conf. on Acoustics, Speech and Signal Processing, Munich, pp. 1367-1370.
Wang et al., "A 1200/2400 BPS Coding Suite Based on MELP," Proc. IEEE Workshop on Speech Coding, 2002, pp. 90-92 (2002).

Wang, Tian et al., "A 1200 BPS Speech Coder Based on MELP", *in Proceedings of the IEEE International Conference on Acoustics, Speech and Signal Processing*, Jun. 2000, pp. 1375-1378.

Wang et al., "Performance Comparison of Intraframe and Interframe LSF Quantization in Packet Networks," Proc. IEEE Workshop on Speech Coding, 2000, pp. 126-128 (2000).

Wang et al., "Wideband Speech Coder Employing T-codes and Reversible Variable Length Codes," Proc. IEEE Workshop on Speech Coding, 2002, pp. 117-119 (2002).

ITU-T, "ITU-T Recommendation G.722, General Aspects of Digital Transmission Systems—Terminal Equipments 7 kHz Audio—Coding within 64 kbit/s," 75 pp. (1988).

ITU-T, "ITU-T Recommendation G.722.1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 26 pp. (1999).

ITU-T, "ITU-T Recommendation G.722.1—Corrigendum 1, Series G: Transmission Systems and Media, Digital Systems and Networks. Digital terminal equipments—Coding of analogue signals by methods other than PCM—Coding at 24 and 32 kbit/s for hands-free operation in systems with low frame loss," 9 pp. (2000).

ITU-T, "ITU-T Recommendation G.722.1 Annex A, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex A: Packet format, capability identifiers and capability parameters" 9 pp. (2000).

ITU-T, "ITU-T Recommendation G.722.1 Annex B, Series G: Transmission Systems and Media, Digital Systems and Networks. Digital terminal equipments—Coding of analogue signals by methods other than PCM—Coding at 24 and 32 kbit/s for hands-free operation in systems with low frame loss, Annex B: Floating-point implementation for G.722.1" 9 pp. (2000).

ITU-T, "ITU-T Recommendation G.722.2, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 71 pp. (2003).

ITU-T, "ITU-T Recommendation G.722.2 Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB)," 1 p. (2004).

ITU-T, "ITU-T Recommendation G.722.2 Annex A, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex A: Comfort noise aspects," 15 pp. (2002).

ITU-T, "ITU-T Recommendation G.722.2 Annex B, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 13 pp. (2002).

ITU-T, "ITU-T Recommendation G.722.2 Annex B Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex B: Source Controlled Rate Operation," 1 p. (2003).

ITU-T, "ITU-T Recommendation G.722.2 Annex C Erratum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex C: Fixed-point C-code," 2 pp. (2004).

ITU-T, "ITU-T Recommendation G.722.2 Annex D, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex D: Digital test sequences," 13 pp. (2003).

ITU-T, "ITU-T Recommendation G.722.2 Annex E, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 27 pp. (2002).

ITU-T, "ITU-T Recommendation G.722.2 Annex E Corrigendum 1, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex E: Frame Structure," 1 p. (2003).

ITU-T, "ITU-T Recommendation G.722.2 Annex F, Series G: Transmission Systems and Media, Digital Systems and Networks. Digital terminal equipments—Coding of analogue signals by methods other than PCM—Wideband coding of speech at around 16 kbit/s using Adaptive Multi-Rate Wideband (AMR-WB), Annex F: AMR-WB using in H.245," 10 pp. (2002).

ITU-T, "ITU-T Recommendation G.723.1, General Aspects of Digital Transmission Systems, Dual Rate Speech Coder for Multimedia Communications Transmitting at 5.3 and 6.3 kbit/s," 31 pp. (1996).

ITU-T, "ITU-T Recommendation G.723.1 Annex A, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex A: Silence compression scheme," 21 pp. (1996).

ITU-T, "ITU-T Recommendation G.723.1 Annex B, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex B: Alternative specification based on floating point arithmetic," 8 pp. (1996).

ITU-T, "ITU-T Recommendation G.723.1 Annex C, Series G: Transmission Systems and Media, Digital transmission systems—Terminal Equipments—Coding of analogue signals by methods other than PCM, Dual Rate Speech Coder for Multimedia Communications Transmitting at 5.3 and 6.3 kbit/s, Annex C: Scalable channel coding scheme for wireless applications," 23 pp. (1996).

ITU-T, "ITU-T Recommendation G.728, General Aspects of Digital Transmission Systems; Terminal Equipment Coding of Speech at 16 kbit/s Using Low-Delay Code Excited Linear Prediction," 65 pp. (1992).

ITU-T, "ITU-T Recommendation G.728 Annex G, General Aspects of Digital Transmission Systems; Terminal Equipment Coding of Speech at 16 kbit/s Using Low-Delay Code Excited Linear Prediction, Annex G: 16 kbit/s Fixed Point Specification," 67 pp. (1994).

ITU-T, "ITU-T Recommendation G.728 Annex G Corrigendum 1, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex G: 26 kbit/s Fixed Point Specification—Corrigendum 1," 11 pp. (2000).

ITU-T, "ITU-T Recommendation G.728 Annex H, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex H: Variable bit rate LD-CELP operation mainly for DCME at rates less than 16 kbit/s," 19 pp. (1999).

ITU-T, "ITU-T Recommendation G.728 Annex I, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex I: Frame or packet loss concealment for the LD-CELP decoder," 25 pp. (1999).

ITU-T, "ITU-T Recommendation G.728 Annex J, Series G: Transmission Systems and Media, Digital Systems and Networks, Digital Transmission Systems; Terminal Equipment Coding of Analogue Signals by methods other than PCM, Coding of speech at 16 kbit/s Using Low-Delay Code Excited Linear Prediction, Annex J: Variable bit-rate operation of LD-CELP mainly for voiceband-data applications in DCME," 40 pp. (1999).

ITU-T, "ITU-T Recommendation G.729, Coding of Speech at 8 kbit/s Using Conjugate-Structure Algebraic-Code-Excited Linear-Prediction (CS-ACELP)," 38 pp. (1996).

European Search Report for PCT/US 99/ 19135, 3 pp.

Microsoft Corporation, "Using the Windows Media Audio 9 Voice Codec," 1 pp. [Downloaded from the World Wide Web on Feb. 26, 2004.].

Fout, "Media Support in the Microsoft Windows Real-Time Communications Client," 4 pp. [Downloaded from the World Wide Web on Feb. 26, 2004.].

Tasaki et al., "Spectral Postfilter Design Based on LSP Transformation," 0-7803-4073-6/97 IEEE, pp. 57-58 (1997).

Kroon et al., "Quantization Procedures for the Excitation of Celp Coders," CH2396-0/87/0000-1649 IEEE, pp. 1649-1652 (1987).

Lefebvre et al., "Spectral Amplitude Warping (SAW) for Noise Spectrum Shaping in Audio Coding," IEEE, pp. 335-338 (1997).

Mustapha et al., "An Adaptive Post-Filtering Technique Based on the Modified Yule-Walker Filter," ICASSP-1999 4 pp. (1999).

Chen et al., "Adaptive Postfiltering for Quality Enhancement of Coded Speech," IEEE Transactions on Speech and Audio Processing, vol. 3, No. 1, pp. 59-71 (1995).

Tasaki et al., "Post Noise Smoother to Improve Low Bit Rate Speech-Coding Performance," 0-7803-5651-9/99 IEEE, pp. 159-161 (1999).

Kabal et al., "Adaptive Postfiltering for Enhancement of Noisy Speech in the Frequency Domain," CH 3006-4/91/0000-0312 IEEE, pp. 312-315.

International Search Report and Written Opinion for PCT/US06/12641.

European Search Report for PCT/US06/12686 dated Aug. 13, 2008, 8 pages.

European Search Report for PCT/US06/013010 (EPC Patent Application No. 06749502.8) dated Jun. 8, 2009, 8 pages.

Singapore Written Opinion, Application No. SG 200717476-6, dated Dec. 19, 2008, 4 pages.

Singapore Examination Report, Application No. SG 200717449-3, dated Jul. 1, 2009, 4 pages.

* cited by examiner

AUDIO CODEC POST-FILTER

TECHNICAL FIELD

Described tools and techniques relate to audio codecs, and particularly to post-processing of decoded speech.

BACKGROUND

With the emergence of digital wireless telephone networks, streaming audio over the Internet, and Internet telephony, digital processing and delivery of speech has become commonplace. Engineers use a variety of techniques to process speech efficiently while still maintaining quality. To understand these techniques, it helps to understand how audio information is represented and processed in a computer.

I. Representation of Audio Information in a Computer

A computer processes audio information as a series of numbers representing the audio. A single number can represent an audio sample, which is an amplitude value at a particular time. Several factors affect the quality of the audio, including sample depth and sampling rate.

Sample depth (or precision) indicates the range of numbers used to represent a sample. More possible values for each sample typically yields higher quality output because more subtle variations in amplitude can be represented. An eight-bit sample has 256 possible values, while a sixteen-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second (Hz). Table 1 shows several formats of audio with different quality levels, along with corresponding raw bit rate costs.

TABLE 1

Bit rates for different quality audio

| Sample Depth (bits/sample) | Sampling Rate (samples/second) | Channel Mode | Raw Bit Rate (bits/second) |
|---|---|---|---|
| 8 | 8,000 | mono | 64,000 |
| 8 | 11,025 | mono | 88,200 |
| 16 | 44,100 | stereo | 1,411,200 |

As Table 1 shows, the cost of high quality audio is high bit rate. High quality audio information consumes large amounts of computer storage and transmission capacity. Many computers and computer networks lack the resources to process raw digital audio. Compression (also called encoding or coding) decreases the cost of storing and transmitting audio information by converting the information into a lower bit rate form. Compression can be lossless (in which quality does not suffer) or lossy (in which quality suffers but bit rate reduction from subsequent lossless compression is more dramatic). Decompression (also called decoding) extracts a reconstructed version of the original information from the compressed form. A codec is an encoder/decoder system.

II. Speech Encoders and Decoders

One goal of audio compression is to digitally represent audio signals to provide maximum signal quality for a given amount of bits. Stated differently, this goal is to represent the audio signals with the least bits for a given level of quality. Other goals such as resiliency to transmission errors and limiting the overall delay due to encoding/transmission/decoding apply in some scenarios.

Different kinds of audio signals have different characteristics. Music is characterized by large ranges of frequencies and amplitudes, and often includes two or more channels. On the other hand, speech is characterized by smaller ranges of frequencies and amplitudes, and is commonly represented in a single channel. Certain codecs and processing techniques are adapted for music and general audio; other codecs and processing techniques are adapted for speech.

One type of conventional speech codec uses linear prediction ("LP") to achieve compression. The speech encoding includes several stages. The encoder finds and quantizes coefficients for a linear prediction filter, which is used to predict sample values as linear combinations of preceding sample values. A residual signal (represented as an "excitation" signal) indicates parts of the original signal not accurately predicted by the filtering. At some stages, the speech codec uses different compression techniques for voiced segments (characterized by vocal chord vibration), unvoiced segments, and silent segments, since different kinds of speech have different characteristics. Voiced segments typically exhibit highly repeating voicing patterns, even in the residual domain. For voiced segments, the encoder achieves further compression by comparing the current residual signal to previous residual cycles and encoding the current residual signal in terms of delay or lag information relative to the previous cycles. The encoder handles other discrepancies between the original signal and the predicted, encoded representation (from the linear prediction and delay information) using specially designed codebooks.

Although speech codecs as described above have good overall performance for many applications, they have several drawbacks. For example, lossy codecs typically reduce bit rate by reducing redundancy in a speech signal, which results in noise or other undesirable artifacts in decoded speech. Accordingly, some codecs filter decoded speech to improve its quality. Such post-filters have typically come in two types: time domain post-filters and frequency domain post-filters.

Given the importance of compression and decompression to representing speech signals in computer systems, it is not surprising that post-filtering of reconstructed speech has attracted research. Whatever the advantages of prior techniques for processing of reconstructed speech or other audio, they do not have the advantages of the techniques and tools described herein.

SUMMARY

In summary, the detailed description is directed to various techniques and tools for audio codecs, and specifically to tools and techniques related to filtering decoded speech. Described embodiments implement one or more of the described techniques and tools including, but not limited to, the following:

In one aspect, a set of filter coefficients for application to a reconstructed audio signal is calculated. The calculation includes performing one or more frequency domain calculations. A filtered audio signal is produced by filtering at least a portion of the reconstructed audio signal in a time domain using the set of filter coefficients.

In another aspect, a set of filter coefficients for application to a reconstructed audio signal is produced. Production of the coefficients includes processing a set of coefficient values representing one or more peaks and one or more valleys. Processing the set of coefficient values includes clipping one or more of the peaks or valleys. At least a portion of the reconstructed audio signal is filtered using the filter coefficients.

In another aspect, a reconstructed composite signal synthesized from plural reconstructed frequency sub-band signals is received. The sub-band signals include a reconstructed first frequency sub-band signal for a first frequency band and a reconstructed second frequency sub-band signal for a second frequency band. At a frequency region around an intersection between the first frequency band and the second frequency band, the reconstructed composite signal is selectively enhanced.

The various techniques and tools can be used in combination or independently.

Additional features and advantages will be made apparent from the following detailed description of different embodiments that proceeds with reference to the accompanying drawings.

DETAILED DESCRIPTION

Described embodiments are directed to techniques and tools for processing audio information in encoding and/or decoding. With these techniques the quality of speech derived from a speech codec, such as a real-time speech codec, is improved. Such improvements may result from the use of various techniques and tools separately or in combination.

Such techniques and tools may include a post-filter that is applied to a decoded audio signal in the time domain using coefficients that are designed or processed in the frequency domain. The techniques may also include clipping or capping filter coefficient values for use in such a filter, or in some other type of post-filter.

The techniques may also include a post-filter that enhances the magnitude of a decoded audio signal at frequency regions where energy may have been attenuated due to decomposition into frequency bands. As an example, the filter may enhance the signal at frequency regions near intersections of adjacent bands.

Although operations for the various techniques are described in a particular, sequential order for the sake of presentation, it should be understood that this manner of description encompasses minor rearrangements in the order of operations, unless a particular ordering is required. For example, operations described sequentially may in some cases be rearranged or performed concurrently. Moreover, for the sake of simplicity, flowcharts may not show the various ways in which particular techniques can be used in conjunction with other techniques.

While particular computing environment features and audio codec features are described below, one or more of the tools and techniques may be used with various different types of computing environments and/or various different types of codecs. For example, one or more of the post-filter techniques may be used with codecs that do not use the CELP coding model, such as adaptive differential pulse code modulation codecs, transform codecs and/or other types of codecs. As another example, one or more of the post-filter techniques may be used with single band codecs or sub-band codecs. As another example, one or more of the post-filter techniques may be applied to a single band of a multi-band codec and/or to a synthesized or unencoded signal including contributions of multiple bands of a multi-band codec.

I. Computing Environment

Figure 1:
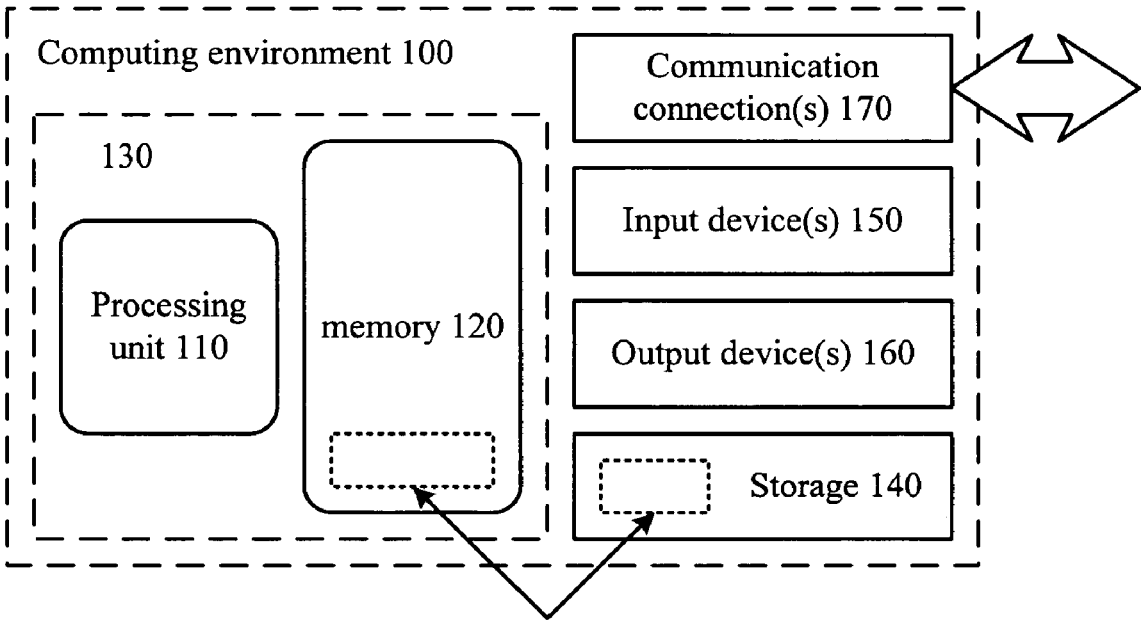
FIG. 1 is a block diagram of a suitable computing environment in which one or more of the described embodiments may be implemented.

FIG. 1 illustrates a generalized example of a suitable computing environment (100) in which one or more of the described embodiments may be implemented. The computing environment (100) is not intended to suggest any limitation as to scope of use or functionality of the invention, as the present invention may be implemented in diverse general-purpose or special-purpose computing environments.

With reference to FIG. 1, the computing environment (100) includes at least one processing unit (110) and memory (120). In FIG. 1, this most basic configuration (130) is included within a dashed line. The processing unit (110) executes computer-executable instructions and may be a real or a virtual processor. In a multi-processing system, multiple processing units execute computer-executable instructions to increase processing power. The memory (120) may be volatile memory (e.g., registers, cache, RAM), non-volatile memory (e.g., ROM, EEPROM, flash memory, etc.), or some combination of the two. The memory (120) stores software (180) implementing one or more of the post-filtering techniques described herein for a speech decoder.

A computing environment (100) may have additional features. In FIG. 1, the computing environment (100) includes storage (140), one or more input devices (150), one or more output devices (160), and one or more communication connections (170). An interconnection mechanism (not shown) such as a bus, controller, or network interconnects the components of the computing environment (100). Typically, operating system software (not shown) provides an operating environment for other software executing in the computing environment (100), and coordinates activities of the components of the computing environment (100).

The storage (140) may be removable or non-removable, and may include magnetic disks, magnetic tapes or cassettes, CD-ROMs, CD-RWs, DVDs, or any other medium which can be used to store information and which can be accessed within the computing environment (100). The storage (140) stores instructions for the software (180).

The input device(s) (150) may be a touch input device such as a keyboard, mouse, pen, or trackball, a voice input device, a scanning device, network adapter, or another device that provides input to the computing environment (100). For audio, the input device(s) (150) may be a sound card, microphone or other device that accepts audio input in analog or digital form, or a CD/DVD reader that provides audio samples to the computing environment (100). The output device(s) (160) may be a display, printer, speaker, CD/DVDwriter, network adapter, or another device that provides output from the computing environment (100).

The communication connection(s) (170) enable communication over a communication medium to another computing entity. The communication medium conveys information such as computer-executable instructions, compressed speech information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The invention can be described in the general context of computer-readable media. Computer-readable media are any available media that can be accessed within a computing environment. By way of example, and not limitation, with the computing environment (100), computer-readable media include memory (120), storage (140), communication media, and combinations of any of the above.

The invention can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description may use terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

II. Generalized Network Environment and Real-time Speech Codec

Figure 2:
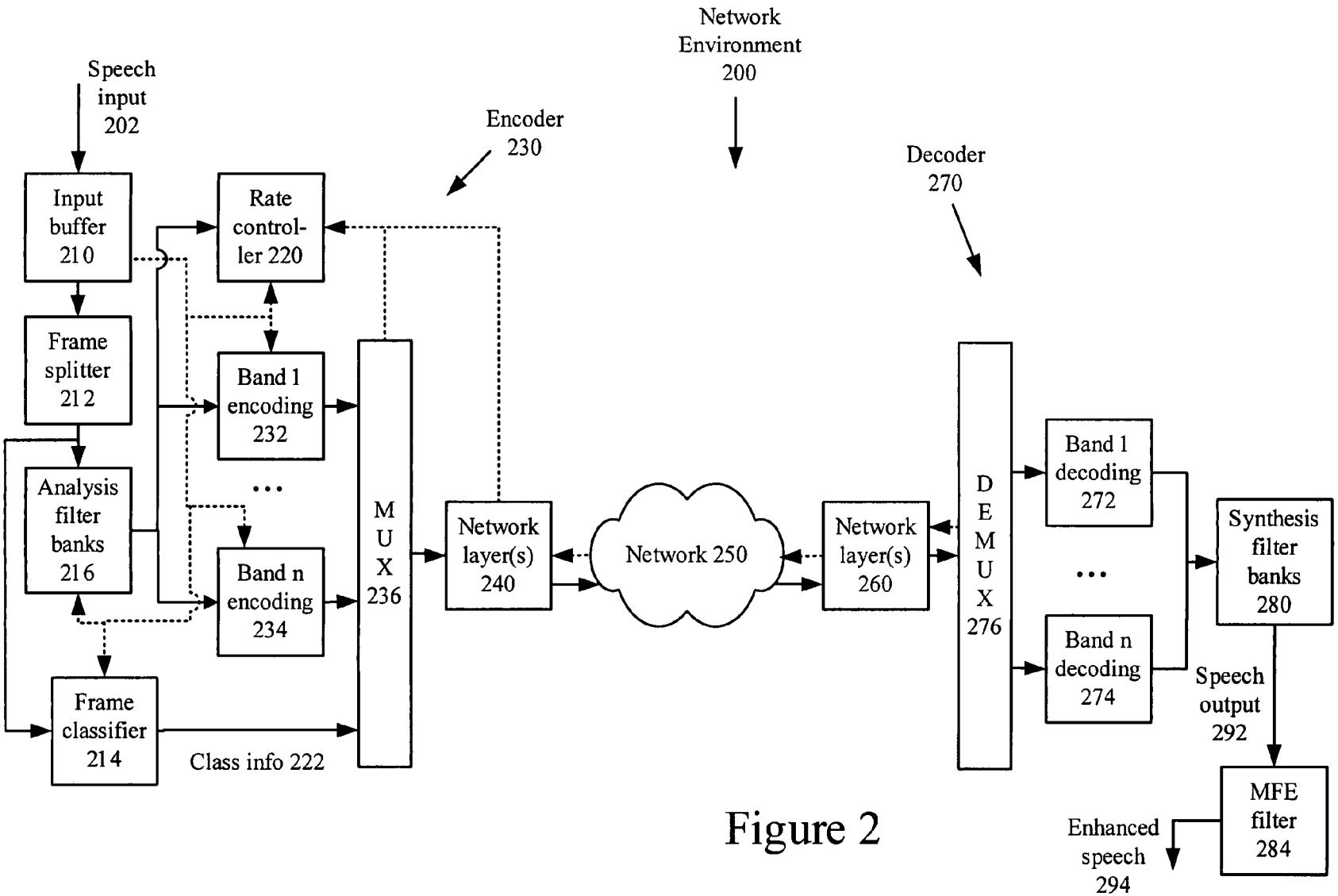
FIG. 2 is a block diagram of a network environment in conjunction with which one or more of the described embodiments may be implemented.

FIG. 2 is a block diagram of a generalized network environment (200) in conjunction with which one or more of the described embodiments may be implemented. A network (250) separates various encoder-side components from various decoder-side components.

The primary functions of the encoder-side and decoder-side components are speech encoding and decoding, respectively. On the encoder side, an input buffer (210) accepts and stores speech input (202). The speech encoder (230) takes speech input (202) from the input buffer (210) and encodes it.

Specifically, a frame splitter (212) splits the samples of the speech input (202) into frames. In one implementation, the frames are uniformly twenty ms long 160 samples for eight kHz input and 320 samples for sixteen kHz input. In other implementations, the frames have different durations, are non-uniform or overlapping, and/or the sampling rate of the input (202) is different. The frames may be organized in a super-frame/frame, frame/sub-frame, or other configuration for different stages of the encoding and decoding.

A frame classifier (214) classifies the frames according to one or more criteria, such as energy of the signal, zero crossing rate, long-term prediction gain, gain differential, and/or other criteria for sub-frames or the whole frames. Based upon the criteria, the frame classifier (214) classifies the different frames into classes such as silent, unvoiced, voiced, and transition (e.g., unvoiced to voiced). Additionally, the frames may be classified according to the type of redundant coding, if any, that is used for the frame. The frame class affects the parameters that will be computed to encode the frame. In addition, the frame class may affect the resolution and loss resiliency with which parameters are encoded, so as to provide more resolution and loss resiliency to more important frame classes and parameters. For example, silent frames typically are coded at very low rate, are very simple to recover by concealment if lost, and may not need protection against loss. Unvoiced frames typically are coded at slightly higher rate, are reasonably simple to recover by concealment if lost, and are not significantly protected against loss. Voiced and transition frames are usually encoded with more bits, depending on the complexity of the frame as well as the presence of transitions. Voiced and transition frames are also difficult to recover if lost, and so are more significantly protected against loss. Alternatively, the frame classifier (214) uses other and/or additional frame classes.

The input speech signal may be divided into sub-band signals before applying an encoding model, such as the CELP encoding model, to the sub-band information for a frame. This may be done using a series of one or more analysis filter banks (such as QMF analysis filters) (216). For example, if a three-band structure is to be used, then the low frequency band can be split out by passing the signal through a low-pass filter. Likewise, the high band can be split out by passing the signal through a high pass filter. The middle band can be split out by passing the signal through a band pass filter, which can include a low pass filter and a high pass filter in series. Alternatively, other types of filter arrangements for sub-band decomposition and/or timing of filtering (e.g., before frame splitting) may be used. If only one band is to be decoded for a portion of the signal, that portion may bypass the analysis filter banks (216).

Figure 3:
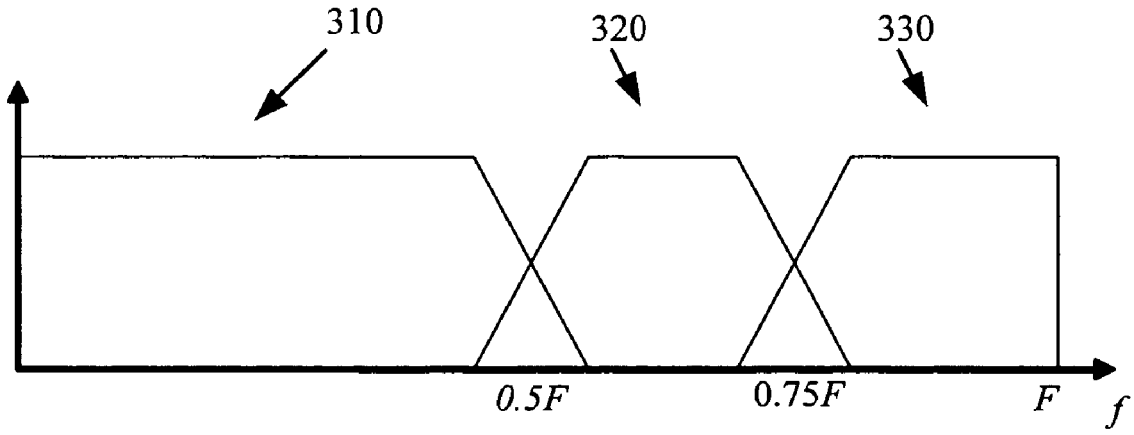
FIG. 3 is a graph depicting one possible frequency sub-band structure that may be used for sub-band encoding.

The number of bands n may be determined by sampling rate. For example, in one implementation, a single band structure is used for eight kHz sampling rate. For 16 kHz and 22.05 kHz sampling rates, a three-band structure is used as shown in FIG. 3. In the three-band structure of FIG. 3, the low frequency band (310) extends half the full bandwidth F (from 0 to 0.5 F). The other half of the bandwidth is divided equally between the middle band (320) and the high band (330). Near the intersections of the bands, the frequency response for a band gradually decreases from the pass level to the stop level, which is characterized by an attenuation of the signal on both sides as the intersection is approached. Other divisions of the frequency bandwidth may also be used. For example, for thirty-two kHz sampling rate, an equally spaced four-band structure may be used.

The low frequency band is typically the most important band for speech signals because the signal energy typically decays towards the higher frequency ranges. Accordingly, the low frequency band is often encoded using more bits than the other bands. Compared to a single band coding structure, the sub-band structure is more flexible, and allows better control of quantization noise across the frequency band. Accordingly, it is believed that perceptual voice quality is improved significantly by using the sub-band structure. However, as discussed below, the decomposition of sub-bands may cause energy loss of the signal at the frequency regions near the intersection of adjacent bands. This energy loss can degrade the quality of the resulting decoded speech signal.

In FIG. 2, each sub-band is encoded separately, as is illustrated by encoding components (232, 234). While the band encoding components (232, 234) are shown separately, the encoding of all the bands may be done by a single encoder, or they may be encoded by separate encoders. Such band encoding is described in more detail below with reference to FIG. 4. Alternatively, the codec may operate as a single band codec. The resulting encoded speech is provided to software for one or more networking layers (240) through a multiplexer ("MUX") (236). The networking layer(s) (240) process the encoded speech for transmission over the network (250). For example, the network layer software packages frames of encoded speech information into packets that follow the RTP protocol, which are relayed over the Internet using UDP, IP, and various physical layer protocols. Alternatively, other and/or additional layers of software or networking protocols are used.

The network (250) is a wide area, packet-switched network such as the Internet. Alternatively, the network (250) is a local area network or other kind of network.

On the decoder side, software for one or more networking layers (260) receives and processes the transmitted data. The network, transport, and higher layer protocols and software in the decoder-side networking layer(s) (260) usually correspond to those in the encoder-side networking layer(s) (240). The networking layer(s) provide the encoded speech information to the speech decoder (270) through a demultiplexer ("DEMUX") (276).

The decoder (270) decodes each of the sub-bands separately, as is depicted in band decoding components (272, 274). All the sub-bands may be decoded by a single decoder, or they may be decoded by separate band decoders.

The decoded sub-bands are then synthesized in a series of one or more synthesis filter banks (such as QMF synthesis filters) (280), which output decoded speech (292). Alternatively, other types of filter arrangements for sub-band synthesis are used. If only a single band is present, then the decoded band may bypass the filter banks (280). If multiple bands are present, decoded speech output (292) may also be passed through a middle frequency enhancement post-filter (284) to improve the quality of the resulting enhanced speech output (294). An implementation of the middle frequency enhancement post-filter is discussed in more detail below.

One generalized real-time speech band decoder is described below with reference to FIG. 6, but other speech decoders may instead be used. Additionally, some or all of the described tools and techniques may be used with other types of audio encoders and decoders, such as music encoders and decoders, or general-purpose audio encoders and decoders.

Aside from these primary encoding and decoding functions, the components may also share information (shown in dashed lines in FIG. 2) to control the rate, quality, and/or loss resiliency of the encoded speech. The rate controller (220) considers a variety of factors such as the complexity of the current input in the input buffer (210), the buffer fullness of output buffers in the encoder (230) or elsewhere, desired output rate, the current network bandwidth, network congestion/noise conditions and/or decoder loss rate. The decoder (270) feeds back decoder loss rate information to the rate controller (220). The networking layer(s) (240, 260) collect or estimate information about current network bandwidth and congestion/noise conditions, which is fed back to the rate controller (220). Alternatively, the rate controller (220) considers other and/or additional factors.

The rate controller (220) directs the speech encoder (230) to change the rate, quality, and/or loss resiliency with which speech is encoded. The encoder (230) may change rate and quality by adjusting quantization factors for parameters or changing the resolution of entropy codes representing the parameters. Additionally, the encoder may change loss resiliency by adjusting the rate or type of redundant coding. Thus, the encoder (230) may change the allocation of bits between primary encoding functions and loss resiliency functions depending on network conditions.

Figure 4:
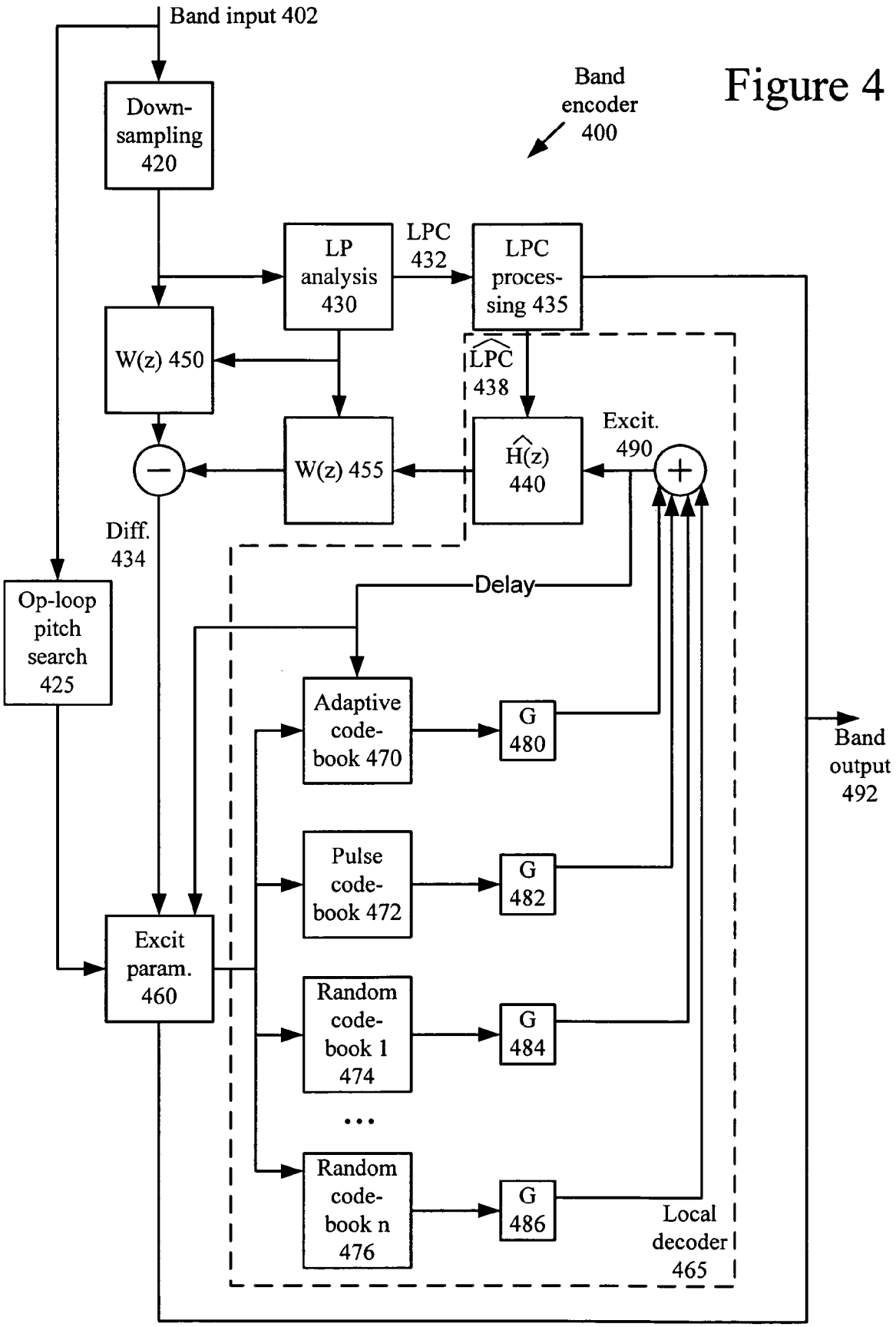
FIG. 4 is a block diagram of a real-time speech band encoder in conjunction with which one or more of the described embodiments may be implemented.

FIG. 4 is a block diagram of a generalized speech band encoder (400) in conjunction with which one or more of the described embodiments may be implemented. The band encoder (400) generally corresponds to any one of the band encoding components (232, 234) in FIG. 2.

The band encoder (400) accepts the band input (402) from the filter banks (or other filters) if the signal is split into multiple bands. If the signal is not split into multiple bands, then the band input (402) includes samples that represent the entire bandwidth. The band encoder produces encoded band output (492).

If a signal is split into multiple bands, then a downsampling component (420) can perform downsampling on each band. As an example, if the sampling rate is set at sixteen kHz and each frame is twenty ms in duration, then each frame includes 320 samples. If no downsampling were performed and the frame were split into the three-band structure shown in FIG. 3, then three times as many samples (i.e., 320 samples per band, or 960 total samples) would be encoded and decoded for the frame. However, each band can be downsampled. For example, the low frequency band (310) can be downsampled from 320 samples to 160 samples, and each of the middle band (320) and high band (330) can be downsampled from 320 samples to 80 samples, where the bands (310, 320, 330) extend over half, a quarter, and a quarter of the frequency range, respectively. (The degree of downsampling (420) in this implementation varies in relation to the frequency ranges of the bands (310, 320, 330). However, other implementations are possible. In later stages, fewer bits are typically used for the higher bands because signal energy typically declines toward the higher frequency ranges.) Accordingly, this provides a total of 320 samples to be encoded and decoded for the frame.

The LP analysis component (430) computes linear prediction coefficients (432). In one implementation, the LP filter uses ten coefficients for eight kHz input and sixteen coefficients for sixteen kHz input, and the LP analysis component (430) computes one set of linear prediction coefficients per frame for each band. Alternatively, the LP analysis component (430) computes two sets of coefficients per frame for each band, one for each of two windows centered at different locations, or computes a different number of coefficients per band and/or per frame.

The LPC processing component (435) receives and processes the linear prediction coefficients (432). Typically, the LPC processing component (435) converts LPC values to a different representation for more efficient quantization and encoding. For example, the LPC processing component (435) converts LPC values to a line spectral pair (LSP) representation, and the LSP values are quantized (such as by vector quantization) and encoded. The LSP values may be intra coded or predicted from other LSP values. Various representations, quantization techniques, and encoding techniques are possible for LPC values. The LPC values are provided in some form as part of the encoded band output (492) for packetization and transmission (along with any quantization parameters and other information needed for reconstruction). For subsequent use in the encoder (400), the LPC processing component (435) reconstructs the LPC values. The LPC processing component (435) may perform interpolation for LPC values (such as equivalently in LSP representation or another representation) to smooth the transitions between different sets of LPC coefficients, or between the LPC coefficients used for different sub-frames of frames.

The synthesis (or "short-term prediction") filter (440) accepts reconstructed LPC values (438) and incorporates them into the filter. The synthesis filter (440) receives an excitation signal and produces an approximation of the original signal. For a given frame, the synthesis filter (440) may buffer a number of reconstructed samples (e.g., ten for a ten-tap filter) from the previous frame for the start of the prediction.

The perceptual weighting components (450, 455) apply perceptual weighting to the original signal and the modeled output of the synthesis filter (440) so as to selectively de-emphasize the formant structure of speech signals to make the auditory systems less sensitive to quantization errors. The perceptual weighting components (450, 455) exploit psychoacoustic phenomena such as masking. In one implementation, the perceptual weighting components (450, 455) apply weights based on the original LPC values (432) received from the LP analysis component (430). Alternatively, the perceptual weighting components (450, 455) apply other and/or additional weights.

Following the perceptual weighting components (450, 455), the encoder (400) computes the difference between the perceptually weighted original signal and perceptually weighted output of the synthesis filter (440) to produce a difference signal (434). Alternatively, the encoder (400) uses a different technique to compute the speech parameters.

The excitation parameterization component (460) seeks to find the best combination of adaptive codebook indices, fixed codebook indices and gain codebook indices in terms of minimizing the difference between the perceptually weighted original signal and synthesized signal (in terms of weighted mean square error or other criteria). Many parameters are computed per sub-frame, but more generally the parameters may be per super-frame, frame, or sub-frame. As discussed above, the parameters for different bands of a frame or sub-frame may be different. Table 2 shows the available types of parameters for different frame classes in one implementation.

TABLE 2

Parameters for different frame classes

| Frame class | Parameter(s) |
|---|---|
| Silent | Class information; LSP; gain (per frame, for generated noise) |
| Unvoiced | Class information; LSP; pulse, random, and gain codebook parameters |
| Voiced Transition | Class information; LSP; adaptive, pulse, random, and gain codebook parameters (per sub-frame) |

In FIG. 4, the excitation parameterization component (460) divides the frame into sub-frames and calculates codebook indices and gains for each sub-frame as appropriate. For example, the number and type of codebook stages to be used, and the resolutions of codebook indices, may initially be determined by an encoding mode, where the mode is dictated by the rate control component discussed above. A particular mode may also dictate encoding and decoding parameters other than the number and type of codebook stages, for example, the resolution of the codebook indices. The parameters of each codebook stage are determined by optimizing the parameters to minimize error between a target signal and the contribution of that codebook stage to the synthesized signal. (As used herein, the term "optimize" means finding a suitable solution under applicable constraints such as distortion reduction, parameter search time, parameter search complexity, bit rate of parameters, etc., as opposed to performing a full search on the parameter space. Similarly, the term "minimize" should be understood in terms of finding a suitable solution under applicable constraints.) For example, the optimization can be done using a modified mean square error technique. The target signal for each stage is the difference between the residual signal and the sum of the contributions of the previous codebook stages, if any, to the synthesized signal. Alternatively, other optimization techniques may be used.

Figure 5:
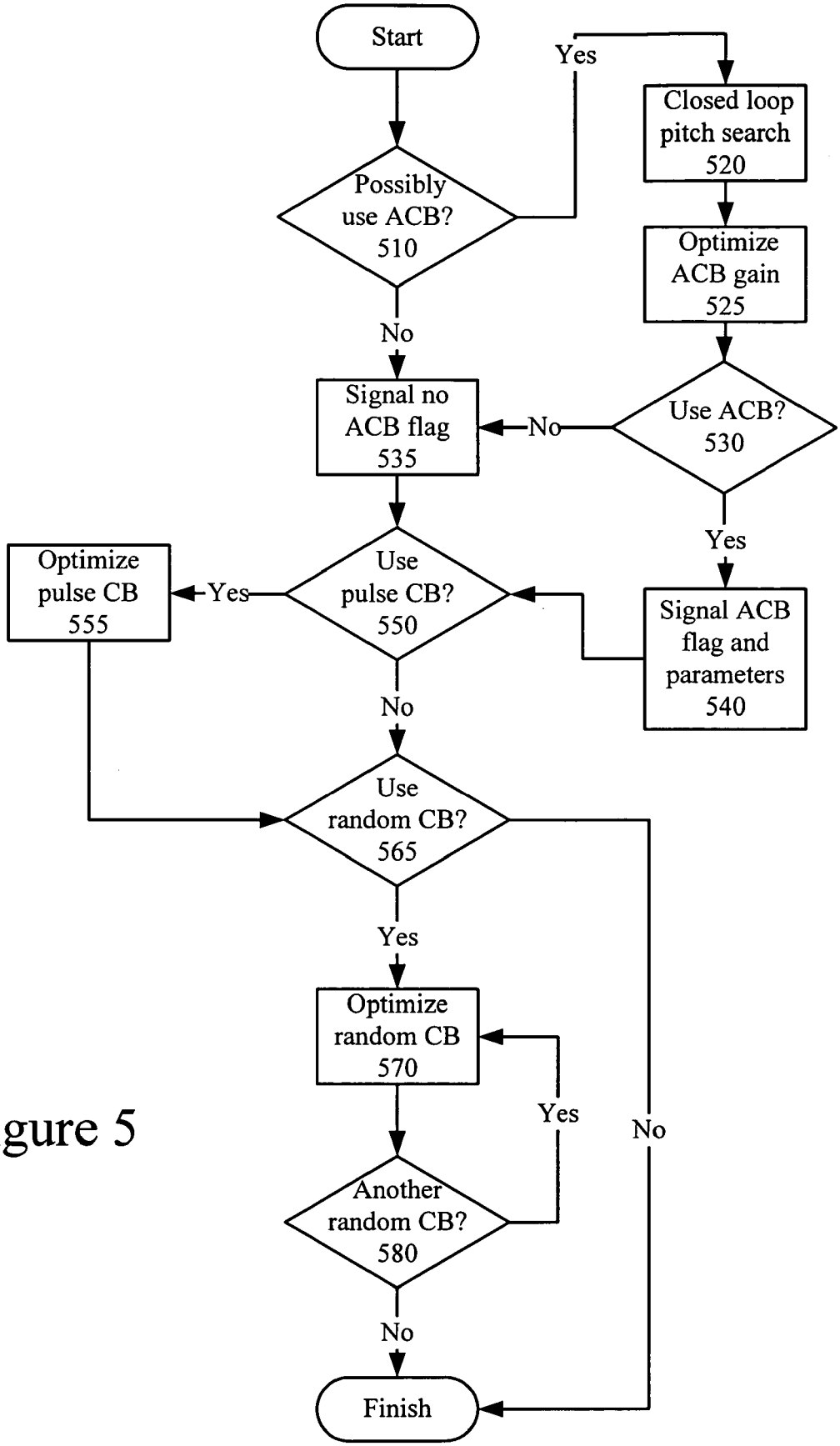
FIG. 5 is a flow diagram depicting the determination of codebook parameters in one implementation.

FIG. 5 shows a technique for determining codebook parameters according to one implementation. The excitation parameterization component (460) performs the technique, potentially in conjunction with other components such as a rate controller. Alternatively, another component in an encoder performs the technique.

Referring to FIG. 5, for each sub-frame in a voiced or transition frame, the excitation parameterization component (460) determines (510) whether an adaptive codebook may be used for the current sub-frame. (For example, the rate control may dictate that no adaptive codebook is to be used for a particular frame.) If the adaptive codebook is not to be used, then an adaptive codebook switch will indicate that no adaptive codebooks are to be used (535). For example, this could be done by setting a one-bit flag at the frame level indicating no adaptive codebooks are used in the frame, by specifying a particular coding mode at the frame level, or by setting a one-bit flag for each sub-frame indicating that no adaptive codebook is used in the sub-frame.

Referring still to FIG. 5, if an adaptive codebook may be used, then the component (460) determines adaptive codebook parameters. Those parameters include an index, or pitch value, that indicates a desired segment of the excitation signal history, as well as a gain to apply to the desired segment. In FIGS. 4 and 5, the component (460) performs a closed loop pitch search (520). This search begins with the pitch determined by the optional open loop pitch search component (425) in FIG. 4. An open loop pitch search component (425) analyzes the weighted signal produced by the weighting component (450) to estimate its pitch. Beginning with this estimated pitch, the closed loop pitch search (520) optimizes the pitch value to decrease the error between the target signal and the weighted synthesized signal generated from an indicated segment of the excitation signal history. The adaptive codebook gain value is also optimized (525). The adaptive codebook gain value indicates a multiplier to apply to the pitch-predicted values (the values from the indicated segment of the excitation signal history), to adjust the scale of the values. The gain multiplied by the pitch-predicted values is the adaptive codebook contribution to the excitation signal for the current frame or sub-frame. The gain optimization (525) and the closed loop pitch search (520) produce a gain value and an index value, respectively, that minimize the error between the target signal and the weighted synthesized signal from the adaptive codebook contribution.

If the component (460) determines (530) that the adaptive codebook is to be used, then the adaptive codebook parameters are signaled (540) in the bit stream. If not, then it is indicated that no adaptive codebook is used for the sub-frame (535), such as by setting a one-bit sub-frame level flag, as discussed above. This determination (530) may include determining whether the adaptive codebook contribution for the particular sub-frame is significant enough to be worth the number of bits required to signal the adaptive codebook parameters. Alternatively, some other basis may be used for the determination. Moreover, although FIG. 5 shows signaling after the determination, alternatively, signals are batched until the technique finishes for a frame or super-frame.

The excitation parameterization component (460) also determines (550) whether a pulse codebook is used. The use or non-use of the pulse codebook is indicated as part of an overall coding mode for the current frame, or it may be indicated or determined in other ways. A pulse codebook is a type of fixed codebook that specifies one or more pulses to be contributed to the excitation signal. The pulse codebook parameters include pairs of indices and signs (gains can be positive or negative). Each pair indicates a pulse to be included in the excitation signal, with the index indicating the position of the pulse and the sign indicating the polarity of the pulse. The number of pulses included in the pulse codebook and used to contribute to the excitation signal can vary depending on the coding mode. Additionally, the number of pulses may depend on whether or not an adaptive codebook is being used.

If the pulse codebook is used, then the pulse codebook parameters are optimized (555) to minimize error between the contribution of the indicated pulses and a target signal. If an adaptive codebook is not used, then the target signal is the weighted original signal. If an adaptive codebook is used, then the target signal is the difference between the weighted original signal and the contribution of the adaptive codebook to the weighted synthesized signal. At some point (not shown), the pulse codebook parameters are then signaled in the bit stream.

The excitation parameterization component (460) also determines (565) whether any random fixed codebook stages are to be used. The number (if any) of the random codebook stages is indicated as part of an overall coding mode for the current frame, or it may be determined in other ways. A random codebook is a type of fixed codebook that uses a pre-defined signal model for the values it encodes. The codebook parameters may include the starting point for an indicated segment of the signal model and a sign that can be positive or negative. The length or range of the indicated segment is typically fixed and is therefore not typically signaled, but alternatively a length or extent of the indicated segment is signaled. A gain is multiplied by the values in the indicated segment to produce the contribution of the random codebook to the excitation signal.

If at least one random codebook stage is used, then the codebook stage parameters for the codebook are optimized (570) to minimize the error between the contribution of the random codebook stage and a target signal. The target signal is the difference between the weighted original signal and the sum of the contribution to the weighted synthesized signal of the adaptive codebook (if any), the pulse codebook (if any), and the previously determined random codebook stages (if any). At some point (not shown), the random codebook parameters are then signaled in the bit stream.

The component (460) then determines (580) whether any more random codebook stages are to be used. If so, then the parameters of the next random codebook stage are optimized (570) and signaled as described above. This continues until all the parameters for the random codebook stages have been determined. All the random codebook stages can use the same signal model, although they will likely indicate different segments from the model and have different gain values. Alternatively, different signal models can be used for different random codebook stages.

Each excitation gain may be quantized independently or two or more gains may be quantized together, as determined by the rate controller and/or other components.

While a particular order has been set forth herein for optimizing the various codebook parameters, other orders and optimization techniques may be used. For example, all random codebooks could be optimized simultaneously. Thus, although FIG. 5 shows sequential computation of different codebook parameters, alternatively, two or more different codebook parameters are jointly optimized (e.g., by jointly varying the parameters and evaluating results according to some non-linear optimization technique). Additionally, other configurations of codebooks or other excitation signal parameters could be used.

The excitation signal in this implementation is the sum of any contributions of the adaptive codebook, the pulse codebook, and the random codebook stage(s). Alternatively, the component (460) of FIG. 4 may compute other and/or additional parameters for the excitation signal.

Referring to FIG. 4, codebook parameters for the excitation signal are signaled or otherwise provided to a local decoder (465) (enclosed by dashed lines in FIG. 4) as well as to the band output (492). Thus, for each band, the encoder output (492) includes the output from the LPC processing component (435) discussed above, as well as the output from the excitation parameterization component (460).

The bit rate of the output (492) depends in part on the parameters used by the codebooks, and the encoder (400) may control bit rate and/or quality by switching between different sets of codebook indices, using embedded codes, or using other techniques. Different combinations of the codebook types and stages can yield different encoding modes for different frames, bands, and/or sub-frames. For example, an unvoiced frame may use only one random codebook stage. An adaptive codebook and a pulse codebook may be used for a low rate voiced frame. A high rate frame may be encoded using an adaptive codebook, a pulse codebook, and one or more random codebook stages. In one frame, the combination of all the encoding modes for all the sub-bands together may be called a mode set. There may be several pre-defined mode sets for each sampling rate, with different modes corresponding to different coding bit rates. The rate control module can determine or influence the mode set for each frame.

Referring still to FIG. 4, the output of the excitation parameterization component (460) is received by codebook reconstruction components (470, 472, 474, 476) and gain application components (480, 482, 484, 486) corresponding to the codebooks used by the parameterization component (460). The codebook stages (470, 472, 474, 476) and corresponding gain application components (480, 482, 484, 486) reconstruct the contributions of the codebooks. Those contributions are summed to produce an excitation signal (490), which is received by the synthesis filter (440), where it is used together with the "predicted" samples from which subsequent linear prediction occurs. Delayed portions of the excitation signal are also used as an excitation history signal by the adaptive codebook reconstruction component (470) to reconstruct subsequent adaptive codebook parameters (e.g., pitch contribution), and by the parameterization component (460) in computing subsequent adaptive codebook parameters (e.g., pitch index and pitch gain values).

Referring back to FIG. 2, the band output for each band is accepted by the MUX (236), along with other parameters. Such other parameters can include, among other information, frame class information (222) from the frame classifier (214) and frame encoding modes. The MUX (236) constructs application layer packets to pass to other software, or the MUX (236) puts data in the payloads of packets that follow a protocol such as RTP. The MUX may buffer parameters so as to allow selective repetition of the parameters for forward error correction in later packets. In one implementation, the MUX (236) packs into a single packet the primary encoded speech information for one frame, along with forward error correction information for all or part of one or more previous frames.

The MUX (236) provides feedback such as current buffer fullness for rate control purposes. More generally, various components of the encoder (230) (including the frame classifier (214) and MUX (236)) may provide information to a rate controller (220) such as the one shown in FIG. 2.

The bit stream DEMUX (276) of FIG. 2 accepts encoded speech information as input and parses it to identify and process parameters. The parameters may include frame class, some representation of LPC values, and codebook parameters. The frame class may indicate which other parameters are present for a given frame. More generally, the DEMUX (276) uses the protocols used by the encoder (230) and extracts the parameters the encoder (230) packs into packets. For packets received over a dynamic packet-switched network, the DEMUX (276) includes a jitter buffer to smooth out short term fluctuations in packet rate over a given period of time. In some cases, the decoder (270) regulates buffer delay and manages when packets are read out from the buffer so as to integrate delay, quality control, concealment of missing frames, etc. into decoding. In other cases, an application layer component manages the jitter buffer, and the jitter buffer is filled at a variable rate and depleted by the decoder (270) at a constant or relatively constant rate.

The DEMUX (276) may receive multiple versions of parameters for a given segment, including a primary encoded version and one or more secondary error correction versions. When error correction fails, the decoder (270) uses concealment techniques such as parameter repetition or estimation based upon information that was correctly received.

Figure 6:
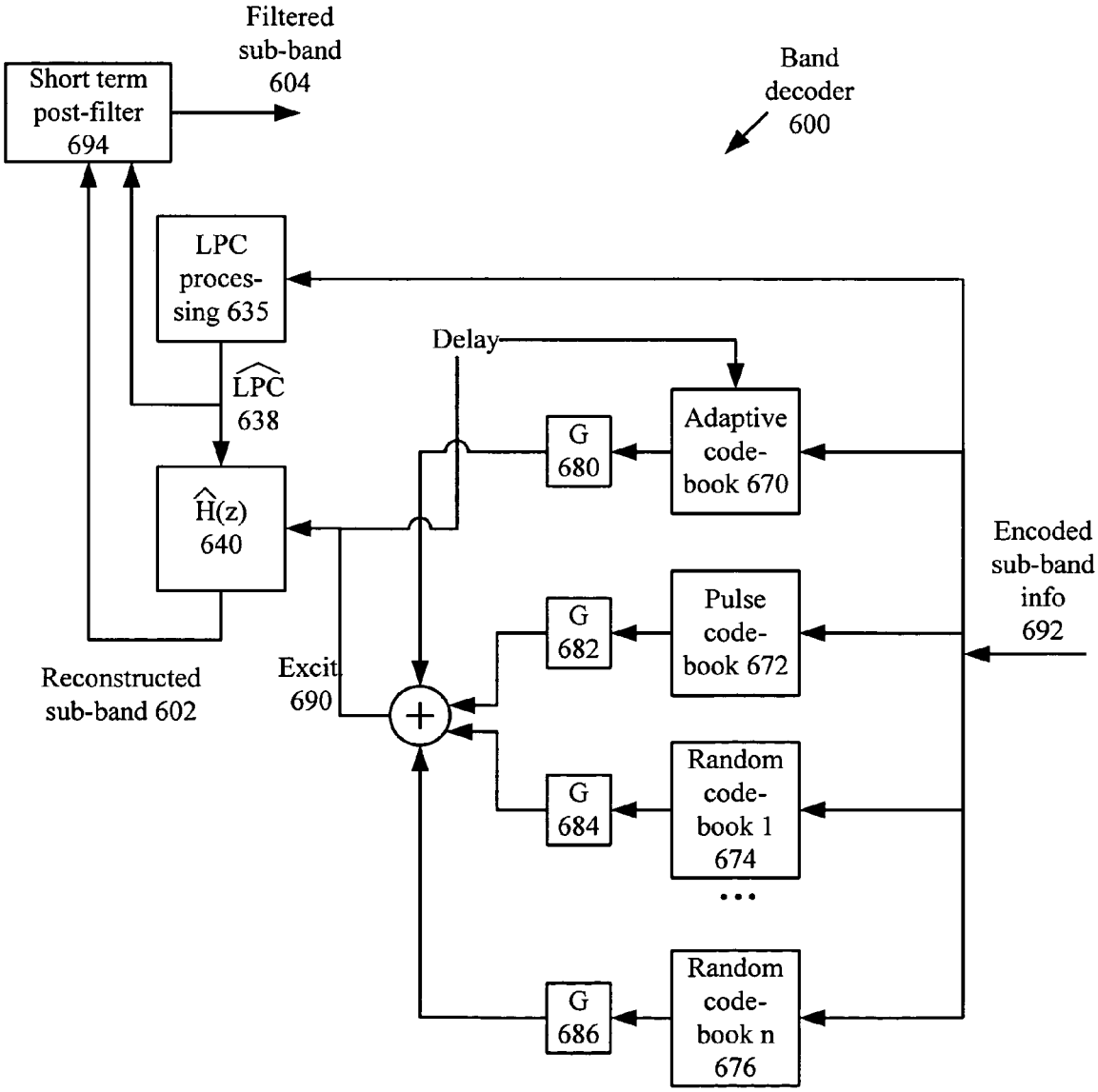
FIG. 6 is a block diagram of a real-time speech band decoder in conjunction with which one or more of the described embodiments may be implemented.

FIG. 6 is a block diagram of a generalized real-time speech band decoder (600) in conjunction with which one or more described embodiments may be implemented. The band decoder (600) corresponds generally to any one of band decoding components (272, 274) of FIG. 2.

The band decoder (600) accepts encoded speech information (692) for a band (which may be the complete band, or one of multiple sub-bands) as input and produces a filtered reconstructed output (604) after decoding and filtering. The components of the decoder (600) have corresponding components in the encoder (400), but overall the decoder (600) is simpler since it lacks components for perceptual weighting, the excitation processing loop and rate control.

The LPC processing component (635) receives information representing LPC values in the form provided by the band encoder (400) (as well as any quantization parameters and other information needed for reconstruction). The LPC processing component (635) reconstructs the LPC values (638) using the inverse of the conversion, quantization, encoding, etc. previously applied to the LPC values. The LPC processing component (635) may also perform interpolation for LPC values (in LPC representation or another representation such as LSP) to smooth the transitions between different sets of LPC coefficients.

The codebook stages (670, 672, 674, 676) and gain application components (680, 682, 684, 686) decode the parameters of any of the corresponding codebook stages used for the excitation signal and compute the contribution of each codebook stage that is used. Generally, the configuration and operations of the codebook stages (670, 672, 674, 676) and gain components (680, 682, 684, 686) correspond to the configuration and operations of the codebook stages (470, 472, 474, 476) and gain components (480, 482, 484, 486) in the encoder (400). The contributions of the used codebook stages are summed, and the resulting excitation signal (690) is fed into the synthesis filter (640). Delayed values of the excitation signal (690) are also used as an excitation history by the adaptive codebook (670) in computing the contribution of the adaptive codebook for subsequent portions of the excitation signal.

The synthesis filter (640) accepts reconstructed LPC values (638) and incorporates them into the filter. The synthesis filter (640) stores previously reconstructed samples for processing. The excitation signal (690) is passed through the synthesis filter to form an approximation of the original speech signal.

The reconstructed sub-band signal (602) is also fed into a short term post-filter (694). The short term post-filter produces a filtered sub-band output (604). Several techniques for computing coefficients for the short term post-filter (694) are described below. For adaptive post-filtering, the decoder (270) may compute the coefficients from parameters (e.g., LPC values) for the encoded speech. Alternatively, the coefficients are provided through some other technique.

Referring back to FIG. 2, as discussed above, if there are multiple sub-bands, the sub-band output for each sub-band is synthesized in the synthesis filter banks (280) to form the speech output (292).

The relationships shown in FIGS. 2-6 indicate general flows of information; other relationships are not shown for the sake of simplicity. Depending on implementation and the type of compression desired, components can be added, omitted, split into multiple components, combined with other components, and/or replaced with like components. For example, in the environment (200) shown in FIG. 2, the rate controller (220) may be combined with the speech encoder (230). Potential added components include a multimedia encoding (or playback) application that manages the speech encoder (or decoder) as well as other encoders (or decoders) and collects network and decoder condition information, and that performs adaptive error correction functions. In alternative embodiments, different combinations and configurations of components process speech information using the techniques described herein.

III. Post-Filter Techniques

In some embodiments, a decoder or other tool applies a short-term post-filter to reconstructed audio, such as reconstructed speech, after it has been decoded. Such a filter can improve the perceptual quality of the reconstructed speech.

Post filters are typically either time domain post-filters or frequency domain post-filters. A conventional time domain post-filter for a CELP codec includes an all-pole linear prediction coefficient synthesis filter scaled by one constant factor and an all-zero linear prediction coefficient inverse filter scaled by another constant factor.

Additionally, a phenomenon known as "spectral tilt" occurs in many speech signals because the amplitudes of lower frequencies in normal speech are often higher than the amplitudes of higher frequencies. Thus, the frequency domain amplitude spectrum of a speech signal often includes a slope, or "tilt." Accordingly, the spectral tilt from the original speech should be present in a reconstructed speech signal. However, if coefficients of a post-filter also incorporate such a tilt, then the effect of the tilt will be magnified in the post-filter output so that the filtered speech signal will be distorted. Thus, some time-domain post-filters also have a first-order high pass filter to compensate for spectral tilt.

The characteristics of time domain post-filters are therefore typically controlled by two or three parameters, which does not provide much flexibility.

A frequency domain post-filter, on the other hand, has a more flexible way of defining the post-filter characteristics. In a frequency domain post-filter, the filter coefficients are determined in the frequency domain. The decoded speech signal is transformed into the frequency domain, and is filtered in the frequency domain. The filtered signal is then transformed back into the time domain. However, the resulting filtered time domain signal typically has a different number of samples than the original unfiltered time domain signal. For example, a frame having 160 samples may be converted to the frequency domain using a 256-point transform, such as a 256-point fast Fourier transform ("FFT"), after padding or inclusion of later samples. When a 256-point inverse FFT is applied to convert the frame back to the time domain, it will yield 256 time domain samples. Therefore, it yields an extra ninety-six samples. The extra ninety-six samples can be overlapped with, and added to, respective samples in the first ninety-six samples of the next frame. This is often referred to as the overlap-add technique. The transformation of the speech signal, as well as the implementation of techniques such as the overlap add technique can significantly increase the complexity of the overall decoder, especially for codecs that do not already include frequency transform components. Accordingly, frequency domain post-filters are typically only used for sinusoidal-based speech codecs because the application of such filters to non-sinusoidal based codecs introduces too much delay and complexity. Frequency domain post-filters also typically have less flexibility to change frame size if the codec frame size varies during coding because the complexity of the overlap add technique discussed above may become prohibitive if a different size frame (such as a frame with 80 samples, rather than 160 samples) is encountered.

While particular computing environment features and audio codec features are described above, one or more of the tools and techniques may be used with various different types of computing environments and/or various different types of codecs. For example, one or more of the post-filter techniques may be used with codecs that do not use the CELP coding model, such as adaptive differential pulse code modulation codecs, transform codecs and/or other types of codecs. As another example, one or more of the post-filter techniques may be used with single band codecs or sub-band codecs. As another example, one or more of the post-filter techniques may be applied to a single band of a multi-band codec and/or to a synthesized or unencoded signal including contributions of multiple bands of a multi-band codec.

A. Example Hybrid Short Term Post-Filters

In some embodiments, a decoder such as the decoder (600) shown in FIG. 6 incorporates an adaptive, time-frequency 'hybrid' filter for post-processing, or such a filter is applied to the output of the decoder (600). Alternatively, such a filter is incorporated into or applied to the output of some other type of audio decoder or processing tool, for example, a speech codec described elsewhere in the present application.

Referring to FIG. 6, in some implementations the short term post-filter (694) is a 'hybrid' filter based on a combination of time-domain and frequency-domain processes. The coefficients of the post-filter (694) can be flexibly and efficiently designed primarily in the frequency domain, and the coefficients can be applied to the short term post-filter (694) in the time domain. The complexity of this approach is typically lower than standard frequency domain post-filters, and it can be implemented in a manner that introduces negligible delay. Additionally, the filter can provide more flexibility than traditional time domain post-filters. It is believed that such a hybrid filter can significantly improve the output speech quality without requiring excessive delay or decoder complexity. Additionally, because the filter (694) is applied in the time domain, it can be applied to frames of any size.

In general, the post-filter (694) may be a finite impulse response ("FIR") filter, whose frequency-response is the result of nonlinear processes performed on the logarithm of a magnitude spectrum of an LPC synthesis filter. The magnitude spectrum of the post-filter can be designed so that the filter (694) only attenuates at spectral valleys, and in some cases at least part of the magnitude spectrum is clipped to be flat around formant regions. As discussed below, the FIR post-filter coefficients can be obtained by truncating a normalized sequence that results from the inverse Fourier transform of the processed magnitude spectrum.

The filter (694) is applied to the reconstructed speech in the time-domain. The filter may be applied to the entire band or to a sub-band. Additionally, the filter may be used alone or in conjunction with other filters, such as long-term post filters and/or the middle frequency enhancement filter discussed in more detail below.

The described post-filter can be operated in conjunction with codecs using various bit-rates, different sampling rates and different coding algorithms. It is believed that the post-filter (694) is able to produce significant quality improvement over the use of voice codecs without the post-filter. Specifically, it is believed that the post-filter (694) reduces the perceptible quantization noise in frequency regions where the signal power is relatively low, i.e., in spectral valleys between formants. In these regions the signal-to-noise ratio is typically poor. In other words, due to the weak signal, the noise that is present is relatively stronger. It is believed that the post-filter enhances the overall speech quality by attenuating the noise level in these regions.

The reconstructed LPC coefficients (638) often contain formant information because the frequency response of the LPC synthesis filter typically follows the spectral envelope of the input speech. Accordingly, LPC coefficients (638) are used to derive the coefficients of the short-term post-filter. Because the LPC coefficients (638) change from one frame to the next or on some other basis, the post-filter coefficients derived from them also adapt from frame to frame or on some other basis.

Figure 7:
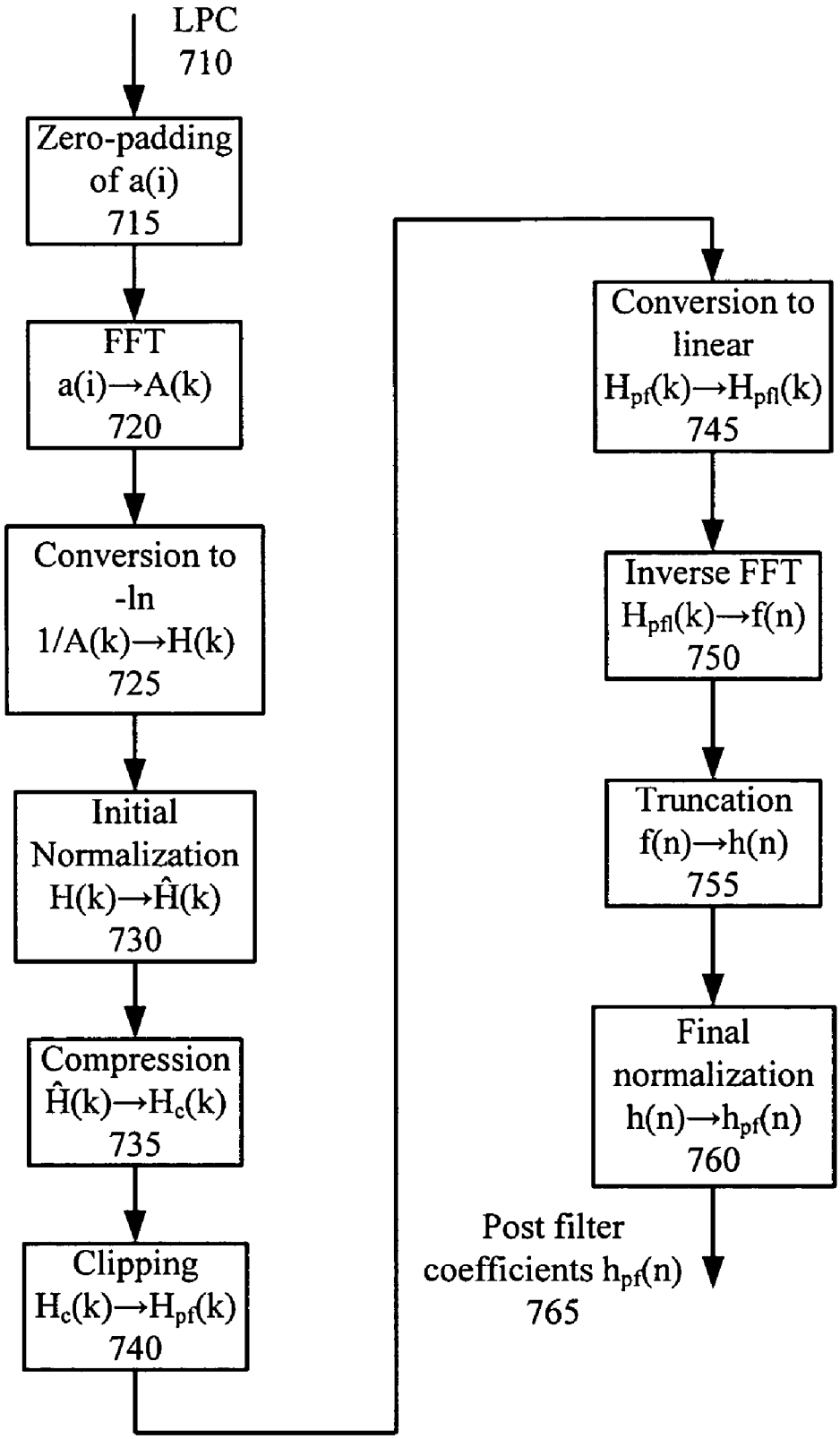
FIG. 7 is a flow diagram depicting a technique for determining post-filter coefficients that may be used in some implementations.

A technique for computing the filter coefficients for the post-filter (694) is illustrated in FIG. 7. The decoder (600) of FIG. 6 performs the technique. Alternatively, another decoder or a post-filtering tool performs the technique.

The decoder (600) obtains an LPC spectrum by zero-padding (715) a set of LPC coefficients (710) a(i), where i=0, 1, 2, . . . , P, and where a(0)=1. The set of LPC coefficients (710) can be obtained from a bit stream if a linear prediction codec, such as a CELP codec, is used. Alternatively, the set of LPC coefficients (710) can be obtained by analyzing a reconstructed speech signal. This can be done even if the codec is not a linear prediction codec. P is the LPC order of the LPC coefficients a(i) to be used in determining the post-filter coefficients. In general, zero padding involves extending a signal (or spectrum) with zeros to extend its time (or frequency band) limits. In the process, zero padding maps a signal of length P to a signal of length N, where N>P. In a full band codec implementation, P is ten for an eight kHz sampling rate, and sixteen for sampling rates higher than eight kHz. Alternatively, P is some other value. For sub-band codecs, P may be a different value for each sub-band. For example, for an sixteen kHz sampling rate using the three sub-band structure illustrated in FIG. 3, P may be ten for the low frequency band (310), six for the middle band (320), and four for the high band (330). In one implementation, N is 128. Alternatively, N is some other number, such as 256.

The decoder (600) then performs an N-point transform, such as an FFT (720), on the zero-padded coefficients, yielding a magnitude spectrum A(k). A(k) is the spectrum of the zero-padded LPC inverse filter, for k=0, 1, 2, . . . , N−1. The inverse of the magnitude spectrum (namely, 1/|A(k)|) gives the magnitude spectrum of the LPC synthesis filter.

The magnitude spectrum of the LPC synthesis filter is optionally converted to the logarithmic domain (725) to decrease its magnitude range. In one implementation, this conversion is as follows:

$$H(k) = \ln\frac{1}{|A(k)|}$$

where ln is the natural logarithm. However, other operations could be used to decrease the range. For example, a base ten logarithm operation could be used instead of a natural logarithm operation.

Three optional non-linear operations are based on the values of H(k): normalization (730), non-linear compression (735), and clipping (740).

Normalization (730) tends to make the range of H(k) more consistent from frame to frame and band to band. Normalization (730) and non-linear compression (735) both reduce the range of the non-linear magnitude spectrum so that the speech signal is not altered too much by the post-filter. Alternatively, additional and/or other techniques could be used to reduce the range of the magnitude spectrum.

In one implementation, initial normalization (730) is performed for each band of a multi-band codec as follows:

$$\hat{H}(k)=H(k)-H_{min}+0.1$$

where $H_{min}$ is the minimum value of H(k), for k=0, 1, 2, . . . , N−1.

Normalization (730) may be performed for a full band codec as follows:

$$\hat{H}(k) = \frac{H(k) - H_{\min}}{H_{\max} - H_{\min}} + 0.1$$

where $H_{min}$ is the minimum value of H(k), and $H_{max}$ is the maximum value of H(k), for k=0, 1, 2, . . . , N−1. In both the normalization equations above, a constant value of 0.1 is added to prevent the maximum and minimum values of $\hat{H}(k)$ from being 1 and 0, respectively, thereby making non-linear compression more effective. Other constant values, or other techniques, may alternatively be used to prevent zero values.

Nonlinear compression (735) is performed to further adjust the dynamic range of the non-linear spectrum as follows:

$$H_c(k)=\beta^*|\hat{H}(k)|^{\gamma}$$

where k=0, 1, . . . , N−1. Accordingly, if a 128-point FFT was used to convert the coefficients to the frequency domain, then k=0, 1, . . . , 127. Additionally, $\beta=\eta^*(H_{max}-H_{min})$, with η and γ taken as appropriately chosen constant factors. The values of η and γ may be chosen according to the type of speech codec and the encoding rate. In one implementation, the η and γ parameters are chosen experimentally. For example, γ is chosen as a value from the range of 0.125 to 0.135, and η is chosen from the range of 0.5 to 1.0. The constant values can be adjusted based on preferences. For example, a range of constant values is obtained by analyzing the predicted spectrum distortion (mainly around peaks and valleys) resulting from various constant values. Typically, it is desirable to choose a range that does not exceed a predetermined level of predicted distortion. The final values are then chosen from among a set of values within the range using the results of subjective listening tests. For example, in a post-filter with an eight kHz sampling rate, η is 0.5 and γ is 0.125, and in a post-filter with a sixteen kHz sampling rate, η is 1.0 and γ is 0.135.

Clipping (740) can be applied to the compressed spectrum, $H_c(k)$, as follows:

$$H_{pf}(k) = \begin{cases} \lambda * H_{mean} & H_c(k) > \lambda * H_{mean} \\ H_c(k) & \text{otherwise} \end{cases}$$

where $H_{mean}$ is the mean value of $H_c(k)$, and λ is a constant. The value of λ may be chosen differently according to the type of speech codec and the encoding rate. In some implementations, λ is chosen experimentally (such as a value from 0.95 to 1.1), and it can be adjusted based on preferences. For example, the final values of λ may be chosen using the results of subjective listening tests. For example, in a post-filter with an eight kHz sampling rate, λ is 1.1, and in post-filter operating at a sixteen kHz sampling rate, λ is 0.95.

This clipping operation caps the values of $H_{pf}(k)$ at a maximum, or ceiling. In the above equations, this maximum is represented as $\lambda^*H_{mean}$. Alternatively, other operations are used to cap the values of the magnitude spectrum. For example, the ceiling could be based on the median value of $H_c(k)$, rather than the mean value. Also, rather than clipping all the high $H_c(k)$ values to a specific maximum value (such as $\lambda^*H_{mean}$), the values could be clipped according to a more complex operation.

Clipping tends to result in filter coefficients that will attenuate the speech signal at its valleys without significantly changing the speech spectrum at other regions, such as formant regions. This can keep the post filter from distorting the speech formants, thereby yielding higher quality speech output. Additionally, clipping can reduce the effects of spectral tilt because clipping flattens the post-filter spectrum by reducing the large values to the capped value, while the values around the valleys remain substantially unchanged.

When conversion to the logarithmic domain was performed, the resulting clipped magnitude spectrum, $H_{pf}(k)$, is converted (745) from the log domain to the linear domain, for example, as follows:

$$H_{pft}(k)=\exp(H_{pf}(k))$$

where exp is the inverse natural logarithm function.

An N-point inverse fast Fourier transform (750) is performed on $H_{pft}(k)$, yielding a time sequence of f(n), where n=0, 1, . . . , N−1, and N is the same as in the FFT operation (720) discussed above. Thus, f(n) is an N-point time sequence.

In FIG. 7, the values of f(n) are truncated (755) by setting the values to zero for n>M−1, as follows:

$$h(n) = \begin{cases} f(n) & n = 0, 1, 2, \ldots M-1 \\ 0 & n > M-1 \end{cases}$$

where M is the order of the short term post-filter. In general, a higher value of M yields higher quality filtered speech. However, the complexity of the post-filter increases as M increases. The value of M can be chosen, taking these trade-offs into consideration. In one implementation, M is seventeen.

The values of h(n) are optionally normalized (760) to avoid sudden changes between frames. For example, this is done as follows:

$$h_{pf}(n) = \begin{cases} 1 & n = 0 \\ h(n)/h(0) & n = 1, 2, 3, \ldots M-1 \end{cases}$$

Alternatively, some other normalization operation is used. For example, the following operation may be used:

$$h_n(n) = \frac{h(n)}{\sqrt{\sum_{n=0}^{M-1} h^2(n)}}$$

In an implementation where normalization yields post filter coefficients $h_{pf}(n)$ (765), a FIR filter with coefficients of $h_{pf}(n)$ (765) is applied to the synthesized speech in the time domain. Thus, in this implementation, the first-order post-filter coefficient (n=0) is set to a value of one for every frame to prevent significant deviations of the filter coefficients from one frame to the next.

B. Example Middle Frequency Enhancement Filters

In some embodiments, a decoder such as the decoder (270) shown in FIG. 2 incorporates a middle frequency enhancement filter for post-processing, or such a filter is applied to the output of the decoder (270). Alternatively, such a filter is incorporated into or applied to the output of some other type of audio decoder or processing tool, for example, a speech codec described elsewhere in the present application.

As discussed above, multi-band codecs decompose an input signal into channels of reduced bandwidths, typically because sub-bands are more manageable and flexible for coding. Band pass filters, such as the filter banks (216) described above with reference to FIG. 2, are often used for signal decomposition prior to encoding. However, signal decomposition can cause a loss of signal energy at the frequency regions between the pass bands for the band pass filters. The middle frequency enhancement ("MFE") filter helps with this potential problem by amplifying the magnitude spectrum of decoded output speech at frequency regions whose energy was attenuated due to signal decomposition, without significantly altering the energy at other frequency regions.

In FIG. 2, an MFE filter (284) is applied to the output of the band synthesis filter(s), such as the output (292) of the filter banks (280). Accordingly, if the band n decoders (272, 274) are as shown in FIG. 6, the short term post-filter (694) is applied separately to each reconstructed band of a sub-band decoder, while the MFE filter (284) is applied to the combined or composite reconstructed signal including contributions of the multiple sub-bands. As noted, alternatively, a MFE filter is applied in conjunction with a decoder having another configuration.

In some implementations, the MFE filter is a second-order band-pass FIR filter. It cascades a first-order low-pass filter and a first-order high-pass filter. Both first-order filters can have identical coefficients. The coefficients are typically chosen so that the MFE filter gain is desirable at pass-bands (increasing energy of the signal) and unity at stop-bands (passing through the signal unchanged or relatively unchanged). Alternatively, some other technique is used to enhance frequency regions that have been attenuated due to band decomposition.

The transfer function of one first-order low-pass filter is:

$$H_1 = \frac{1}{1-\mu} + \frac{\mu}{1-\mu} Z^{-1}$$

The transfer function of one first-order high-pass filter is:

$$H_2 = \frac{1}{1+\mu} - \frac{\mu}{1+\mu} Z^{-1}$$

Thus, the transfer function of a second-order MFE filter which cascades the low-pass filter and high-pass filter above is:

$$\begin{aligned} H &= H_1 \cdot H_2 \\ &= \left(\frac{1}{1-\mu} + \frac{\mu}{1-\mu} Z^{-1}\right) \cdot \left(\frac{1}{1+\mu} - \frac{\mu}{1+\mu} Z^{-1}\right) \\ &= \frac{1}{1-\mu^2} - \frac{\mu^2}{1-\mu^2} Z^{-2} \end{aligned}$$

The corresponding MFE filter coefficients can be represented as:

$$h(n) = \begin{cases} \frac{1}{1-\mu^2} & n = 0 \\ -\frac{\mu^2}{1-\mu^2} & n = 2 \\ 0 & \text{otherwise} \end{cases}$$

The value of μ can be chosen by experiment. For example, a range of constant values is obtained by analyzing the predicted spectrum distortion resulting from various constant values. Typically, it is desirable to choose a range that does not exceed a predetermined level of predicted distortion. The final values is then chosen from among a set of values within the range using the results of subjective listening tests. In one implementation, when a sixteen kHz sampling rate is used, and the speech is broken into the following three bands (zero to eight kHz, eight to twelve kHz, and twelve to sixteen kHz), it can be desirable to enhance the region around eight kHz, and μ is chosen to be 0.45. Alternatively, other values of p are chosen, especially if it is desirable to enhance some other frequency region. Alternatively, the MFE filter is implemented with one or more band pass filters of different design, or the MFE filter is implemented with one or more other filters.

Having described and illustrated the principles of our invention with reference to described embodiments, it will be recognized that the described embodiments can be modified in arrangement and detail without departing from such principles. It should be understood that the programs, processes, or methods described herein are not related or limited to any particular type of computing environment, unless indicated otherwise. Various types of general purpose or specialized computing environments may be used with or perform operations in accordance with the teachings described herein. Elements of the described embodiments shown in software may be implemented in hardware and vice versa.

In view of the many possible embodiments to which the principles of our invention may be applied, we claim as our invention all such embodiments as may come within the scope and spirit of the following claims and equivalents thereto.

We claim:

1. A computer-implemented method comprising:

calculating a set of filter coefficients for application to a reconstructed audio signal, wherein the calculating the set of filter coefficients comprises:

performing a transform of a set of initial time domain values from a time domain into a frequency domain, thereby producing a set of initial frequency domain values;

performing one or more frequency domain calculations using the initial frequency domain values to produce a set of processed frequency domain values; and performing a transform of the processed frequency domain values from the frequency domain into the time domain, thereby producing a set of processed time domain values; and producing a filtered audio signal by filtering at least a portion of the reconstructed audio signal in a time domain using the set of filter coefficients; and wherein performing one or more frequency domain calculations using the initial frequency domain values to produce a set of processed frequency domain values comprises clipping frequency domain values in the frequency domain such that only those frequency domain values which exceed a maximum clip value are clipped.

2. The method of claim 1, wherein the filtered audio signal represents a frequency sub-band of the reconstructed audio signal.

3. The method of claim 1, wherein calculating the set of filter coefficients further comprises:

before the transform of the initial time domain values, padding the initial time domain values up to a length for the transform of the initial time domain values; and after the transform of the processed frequency domain values, truncating the set of processed time domain values in the time domain.

4. The method of claim 1, wherein the set of initial time domain values comprises a set of linear prediction coefficients.

5. The method of claim 4, wherein clipping the frequency domain values in the frequency domain comprises capping a spectrum derived from the set of liner prediction coefficients at a maximum value.

6. The method of claim 4, wherein performing the one or more frequency domain calculations comprises reducing a range of a spectrum derived from the set of linear prediction coefficients.

7. The method of claim 6, wherein reducing a range of a spectrum derived from the set of linear prediction coefficients comprises normalizing values in the spectrum.

8. The method of claim 7, wherein the linear prediction coefficients are for a multi-band codec and the normalizing values in the spectrum comprises normalizing values within a single band.

9. The method of claim 8, wherein the linear prediction coefficients are for a full band codec and the normalizing values in the spectrum comprises normalizing values for the full band.

10. The method of claim 6, wherein reducing a range of a spectrum derived from the set of linear prediction coefficients comprises performing nonlinear compression on values in the spectrum.

11. The method of claim 1, wherein the one or more frequency domain calculations comprises one or more calculations in a logarithmic domain.

12. The method of claim 1, wherein the filtered audio signal comprises plural reconstructed frequency sub-band signals, the plural reconstructed frequency sub-band signals including a reconstructed first frequency sub- band signal for a first frequency band and a reconstructed second frequency sub-band signal for a second frequency band; and the method further comprises selectively enhancing the reconstructed composite signal at a frequency region around an intersection between the first frequency band and the second frequency band, wherein enhancing the reconstructed composite signal comprises passing the reconstructed composite signal through a band pass filter, wherein a pass band of the band pass filter corresponds to the frequency region around the intersection between the first frequency band and the second frequency band.

13. A method comprising:

producing a set of filter coefficients for application to a reconstructed audio signal, including processing a set of values in a frequency domain representing one or more peaks and one or more valleys, wherein the processing the set of values in the frequency domain comprises clipping one or more of the peaks or valleys, and wherein the clipping includes capping the set of values in the frequency domain at a maximum clip value by setting values which exceed the maximum clip value to the clip value and maintaining the values which do not exceed the maximum clip value; and filtering at least a portion of the reconstructed audio signal using the filter coefficients.

14. The method of claim 13, wherein producing a set of filter coefficients further comprises calculating the maximum clip value as a function of an average of the set of values in the frequency domain.

15. The method of claim 13, wherein the set of values in the frequency domain is based at least in part on a set of linear prediction coefficient values.

16. The method of claim 13, wherein the clipping is performed in the frequency domain.

17. The method of claim 13, wherein the filtering is performed in a time domain.

18. The method of claim 13, further comprising reducing a range of the set of values in the frequency domain before the clipping.

19. The method of claim 18, wherein reducing a range of the set of values in the frequency domain before the clipping comprises normalizing the values in the frequency domain.

20. The method of claim 18, wherein reducing a range of the set of values in the frequency domain before the clipping comprises performing nonlinear compression on values in the frequency domain.

21. The method of claim 13, wherein capping the set of values in the frequency domain at a maximum clip value comprises performing one or more calculations in a logarithmic domain.

22. The method of claim 13, further comprising:

receiving a reconstructed composite signal synthesized from plural reconstructed frequency sub-band signals, the plural reconstructed frequency sub-band signals including a reconstructed first frequency sub-band signal for a first frequency band and a reconstructed second frequency sub-band signal for a second frequency band; and selectively enhancing the reconstructed composite signal at a frequency region around an intersection between the first frequency band and the second frequency band, wherein the enhancing comprises increasing signal energy in the frequency region.

23. A computer-implemented method comprising:

receiving a reconstructed composite signal synthesized from plural reconstructed frequency sub-band signals, the plural reconstructed frequency sub-band signals including a reconstructed first frequency sub-band signal for a first frequency band and a reconstructed second frequency sub-band signal for a second frequency band; and selectively enhancing the reconstructed composite signal at a frequency region around an intersection between the first frequency band and the second frequency band, wherein enhancing the reconstructed composite signal comprises passing the reconstructed composite signal through a baud pass filter, wherein a pass band of the band pass filter corresponds to the frequency region around the intersection between the first frequency band and the second frequency band.

24. The method of claim 23 further comprising:

decoding coded information to produce the plural reconstructed frequency sub-band signals; and synthesizing the plural reconstructed frequency sub-band signals to produce the reconstructed composite signal.

25. The method of claim 23, wherein the band pass filter comprises a low pass filter in series with a high pass filter.

26. The method of claim 23, wherein the band pass filter has unity gain at one or more stop bands and greater than unity gain at the pass band.

27. The method of claim 23, wherein the enhancing further comprises increasing signal energy in the frequency region.

28. A method comprising:

producing a set of filter coefficients for application to a reconstructed audio signal, including processing a set of coefficient values representing one or more peaks and one or more valleys, wherein the processing the set of coefficient values comprises clipping one or more of the peaks or valleys such that only those coefficient values which exceed a maximum clip value are clipped, and wherein the set of coefficient values is based at least in part on a set of linear prediction coefficient values; and filtering at least a portion of the reconstructed audio signal using the filter coefficients.

29. A method comprising:

producing a set of filter coefficients for application to a reconstructed audio signal, including processing a set of coefficient values representing one or more peaks and one or more valleys, wherein the processing the set of coefficient values comprises clipping one or more of the peaks or valleys such that only those coefficient values which exceed a maximum clip value are clipped, and wherein the clipping is performed in a frequency domain; and filtering at least a portion of the reconstructed audio signal using the filter coefficients.

30. A method comprising:

producing a set of filter coefficients for application to a reconstructed audio signal, including processing a set of coefficient values representing one or more peaks and one or more valleys, wherein the processing the set of coefficient values comprises clipping one or more of the peaks or valleys such that only those coefficient values which exceed a maximum clip value are clipped; and filtering at least a portion of the reconstructed audio signal using the filter coefficients, wherein the filtering is performed in a time domain.

31. A method comprising:

producing a set of filter coefficients for application to a reconstructed audio signal, including processing a set of coefficient values representing one or more peaks and one or more valleys, wherein the processing the set of coefficient values comprises:

reducing a range of the set of coefficient values; and clipping one or more of the peaks or valleys such that only those coefficient values which exceed a maximum clip value are clipped; and filtering at least a portion of the reconstructed audio signal using the filter coefficients.

* * * * *

UNITED STATES PATENT AND TRADEMARK OFFICE

CERTIFICATE OF CORRECTION

PATENT NO. : 7,707,034 B2
APPLICATION NO. : 11/142603
DATED : April 27, 2010
INVENTOR(S) : Xiaoqin Sun et al.

It is certified that error appears in the above-identified patent and that said Letters Patent is hereby corrected as shown below:

In column 21, line 62, in Claim 5, delete “liner” and insert -- linear --, therefor.

In column 22, line 23, in Claim 12, delete “sub- band” and insert -- sub-band --, therefor.

In column 23, line 35, in Claim 23, delete “baud” and insert -- band --, therefor.

Signed and Sealed this
Fifteenth Day of February, 2011

David J. Kappos

David J. Kappos
*Director of the United States Patent and Trademark Office*